US005321468A

United States Patent [19]

Nakane et al.

[11] Patent Number: 5,321,468

[45] Date of Patent: Jun. 14, 1994

[54] IMAGE FORMING APPARATUS HAVING INFERENCE MEANS AND METHOD OF MANUFACTURING THE SAME

[75] Inventors: Rintaro Nakane, Yokohama; Jiro Egawa, Yokosuka, both of Japan

[73] Assignee: Kabushiki Kaisha Toshiba, Kawasaki, Japan

[21] Appl. No.: 35,953

[22] Filed: Mar. 23, 1993

[30] Foreign Application Priority Data

Sep. 24, 1992 [JP] Japan ..... 4-277701

[51] Int. Cl.[5] ..... G03G 21/00

[52] U.S. Cl. ..... 355/208; 355/204; 355/246; 395/900; 430/43

[58] Field of Search ..... 395/900; 355/200, 202, 355/204, 208, 326, 327, 328, 246; 430/42, 43

[56] References Cited

U.S. PATENT DOCUMENTS

| | | | |
|---|---|---|---|
| 4,277,162 | 7/1981 | Kasahara et al. | 355/208 |
| 4,318,610 | 3/1982 | Grace | 355/246 |
| 4,870,460 | 9/1989 | Harada et al. | 355/246 |
| 4,894,685 | 1/1990 | Shoji | 355/326 X |
| 4,975,747 | 12/1990 | Higuchi | 355/246 |
| 5,029,314 | 7/1991 | Katsumi et al. | 355/208 |
| 5,083,160 | 1/1992 | Suzuki et al. | 355/208 |
| 5,099,279 | 3/1992 | Shimizu | 355/208 |
| 5,107,302 | 4/1992 | Bisaji | 355/246 |
| 5,142,332 | 8/1992 | Osawa et al. | 355/208 |
| 5,204,718 | 4/1993 | Morita | 355/208 X |
| 5,214,476 | 5/1993 | Nomura et al. | 355/204 X |
| 5,216,463 | 6/1993 | Morita | 355/208 |
| 5,220,373 | 6/1993 | Kanaya | 355/204 |

FOREIGN PATENT DOCUMENTS

| | | |
|---|---|---|
| 27975 | 1/1992 | Japan . |
| 27987 | 1/1992 | Japan . |
| 60659 | 2/1992 | Japan . |

*Primary Examiner*—Benjamin R. Fuller
*Assistant Examiner*—John E. Barlow, Jr.
*Attorney, Agent, or Firm*—Foley & Lardner

[57] ABSTRACT

In an image forming apparatus of the present invention, the adhesion amounts of developing agent on a high-density test pattern and a low-density test pattern are measured by a toner density measuring unit. On the basis of the measured adhesion amounts of developing agent on the high-density region and low-density region and the target values of the adhesion amounts, deviations of the adhesion amounts of the high-density region and the low density region are calculated. The renewal amount of contrast voltage and the renewal amount of background voltage corresponding to the high-density region deviation and low-density region deviation are inferred by an inference unit on the basis of inference data stored in a memory unit. The grid bias value and development bias value corresponding to the inferred renewal amounts of contrast voltage and background voltage are calculated. The grid bias voltage and development bias voltage are varied in accordance with the calculated grid bias value and development bias value.

5 Claims, 18 Drawing Sheets

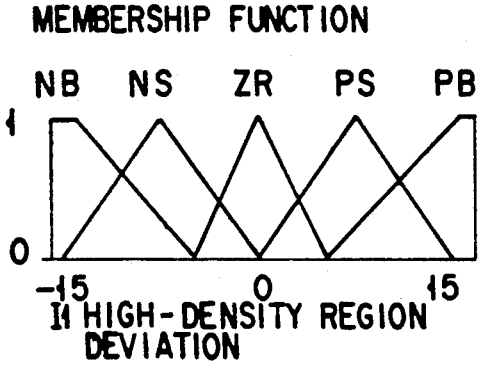
FIG. 21A
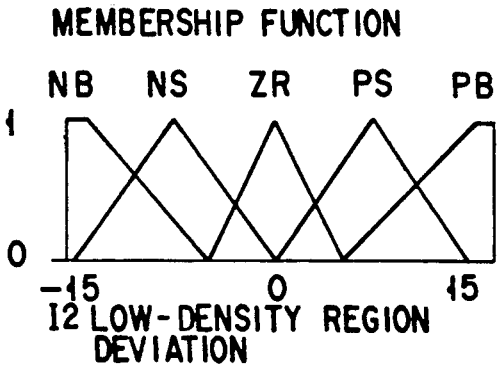
FIG. 21B
RULE MATRIX
| | | I2 | | | | |
|---|---|---|---|---|---|---|
| | | NB | NS | ZR | PS | PB |
| I1 | NB | PB | PB | | | |
| | NS | PS | PS | PS | | |
| | ZR | | | ZR | | |
| | PS | | | NS | NS | NS |
| | PB | | | | NB | NB |
O1 CONTRAST POTENTIAL RENEWAL
FIG. 22A
RULE MATRIX
| | | I2 | | | | |
|---|---|---|---|---|---|---|
| | | NB | NS | ZR | PS | PB |
| I1 | NB | | | | | |
| | NS | | | | PS | PB |
| | ZR | NB | NS | ZR | PS | PB |
| | PS | NB | NS | | | |
| | PB | | | | | |
O2 BACKGROUND POTENTIAL RENEWAL
FIG. 22B
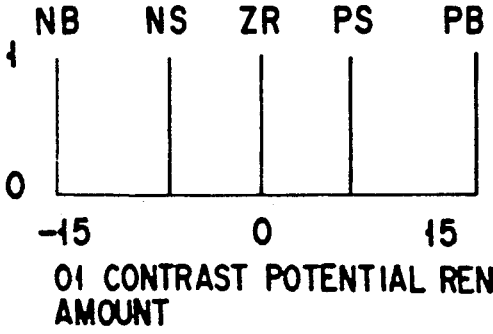
FIG. 23A
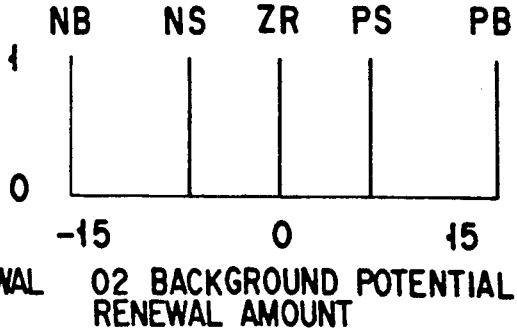
FIG. 23B

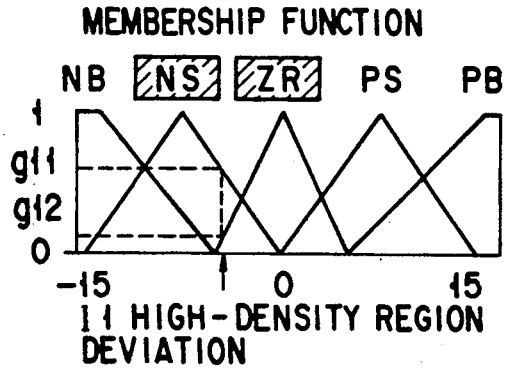
FIG. 24A
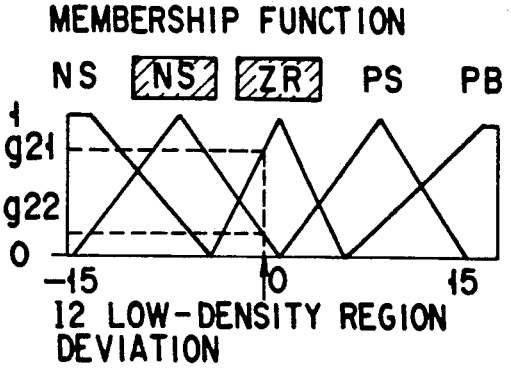
FIG. 24B
RULE MATRIX
| | | I2 | | | | |
|---|---|---|---|---|---|---|
| | | NB | NS | ZR | PS | PB |
| I1 | NB | PB | PB | | | |
| | NS | PS | PS | PS | | |
| | ZR | | | ZR | | |
| | PS | | | NS | NS | NS |
| | PB | | | | NB | NB |
O1 CONTRAST POTENTIAL RENEWAL
FIG. 25A
RULE MATRIX
| | | I2 | | | | |
|---|---|---|---|---|---|---|
| | | NB | NS | ZR | PS | PB |
| I1 | NB | | | | | |
| | NS | | | | PS | PB |
| | ZR | NB | NS | ZR | PS | PB |
| | PS | NB | NS | | | |
| | PB | | | | | |
O2 BACKGROUND POTENTIAL RENEWAL
FIG. 25B
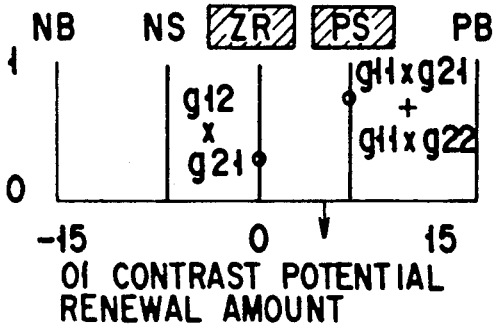
FIG. 26A
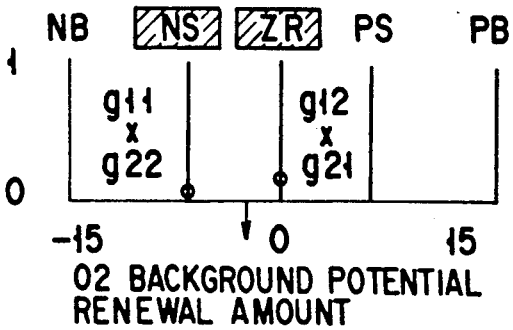
FIG. 26B

IMAGE FORMING APPARATUS HAVING INFERENCE MEANS AND METHOD OF MANUFACTURING THE SAME

BACKGROUND OF THE INVENTION

Field of the Invention

The present invention relates to an image forming apparatus for forming an electrophotographic color image and a method of manufacturing the same, and more particularly to an image forming apparatus with a reduced-capacity memory device for storing data relating to image formation conditions and improved man-machine interface characteristics, and a method of manufacturing the same.

Description of the Related Art

Persons have noticed that copies of the same original obtained by the same copying machine have different densities. A variation in image density in electrophotography results from a variation or degradation in image formation conditions due to ambience change or the passing of time. It is important to prevent variations in image density and stabilize the image density in an analog copying machine, a multi-gradient printer or a digital copying machine. In particular, in a color copying machine, not only density reproducibility but also color reproducibility an adversely affected and, therefore, stabilization of image density is indispensable. In the prior art, image stabilization has been achieved by selecting the materials used in the machine, providing the process itself with a tolerance, and performing maintenance.

However, there are limits on the selection of materials tolerances of the process, and maintenance, requiring a great amount of labor and cost. Further, compared to the frequency of maintenance, the cycle of variation in image density is short. Also, stable image density cannot be obtained with only maintenance.

Moreover, when image formation conditions are stored in a memory device as data on a matrix table, the memory capacity must be increased in order to increase the resolution in accordance with an increase in the number of image formation conditions. In addition, when the image density is slightly varied by the operator, the operator cannot but vary the image density based on his/her experience, as is difficult to vary it on the basis of formulated data.

U.S. Pat. No. 4,870,460 discloses a prior-art technique wherein the density of a test pattern is detected, and a correction output value is determined in a linear mode. Thus, at least one of the electrostatic charge potential, exposure the potential or the development bias is corrected.

However, in general, the relationship between the image formation conditions of electrophotography and the image density (gradient characteristics) is non-linear, and a non-linear correction process is required to perform exact, fine correction.

In the case where two or more correction means (image formation conditions) are controlled on the basis of two or more detected density values, if there is an interaction between the effects on the densities (gradient characteristics) due to output value renewal of the respective correction means, it is necessary to appropriately find the correction amounts of the respective correction means on the basis of the two or more detected values.

A method is of writing output values (e.g. correction values) in relation to two or more inputs (e.g. detected values) in a linear mode or non-linear mode, e.g. on the basis of data obtained by many experiments. In this method, table-format data is stored as a look-up table and suitable data is referred to. Thereby outputs relating to inputs are obtained.

Where the detection or correction precision (resolution) is improved, more data needs to be stored.

Regarding the table data, output values (correction values) are assigned to corresponding input values (detection values). Thus, even if a person (a developer, a maintainance serviceman, or others) views the contents of the table data partly or totally, he/she has difficulty in understanding the contents, it is difficult to change them.

According to the present invention, by using the inference means (contents omitted), (1) the data storage capacity for control can be decreased, as compared to the method of storing table-format data, and (2) since the data is stored in a format which is easily understandable (rules of labels representing categories, correspondency between the labels and associated numerical values) and the display of data (tables graphs) can be confirmed and correction of data is easy.

SUMMARY OF THE INVENTION

The objectives of the present invention is to provide an image forming apparatus having less memory capacity for table data relating to data associated with image formation condition; inferring, by inference means, the data relating to the image formation conditions which are not easily formulated and are empirically determined; improving man-machine interface characteristics; and visually confirming the output based on the inference; and providing a method of manufacturing the image forming apparatus.

In order to achieve the above objectives, there is provided an image forming apparatus for forming an image on an image carrying body under a predetermined image forming condition, comprising:

means for detecting variation amounts of gradient characteristics of images formed on the image carrying body;

means for renewing the image conditions on the basis of the variation of amounts detected by the detection means, so as to decrease the variation amounts of gradient characteristics; and means for inferring renewal amounts of factors of the image formation condition so as to renew the image formation condition by the renewing means, the inference means including means for storing a plurality of data items for setting the renewal amounts of the factors of the image formation condition on the basis of the variation amounts of the gradient characteristics, and processing means for inferring the renewal amounts of the factors of the image formation condition by means of the data items stored in the memory means on the basis of the variation amounts detected by the detecting means.

In addition, in order to achieve the above object, there is provided a method for stabilizing image density changes of an image formed on an image carrying body contained in an image forming apparatus, the image forming apparatus including memory means for storing, an input label group having input labels representing qualitatively the variations of amounts of the gradient characteristics, an output label group having output labels representing qualitatively the renewal amounts of the factors relating to the image formation conditions, an input belonging degree data group including data items representing quantitatively the degrees of matching with the meanings of the labels included in the input label group, an output belonging degree data group including data items representing quantitatively the degrees of matching with the meanings of the labels included in the output label group, and rule data for determining the relationship of correspondency between the labels of the input label group and the labels of the output label group, comprising the steps of:

A) detecting variation amounts of gradient characteristics of images formed on the image carrying body;

B) inferring renewal amounts of factors of the image formation condition on the basis of the variation amounts so as to decrease the variation amounts, the inference step including:

a first search step for searching, from the input label group, at least one of the input labels corresponding to the variation amounts of the gradient characteristics detected by the detection step;

a first processing step for finding the degree of matching with the qualitative data included in the input belonging degree data group with respect to each of at least one of the input labels searched by the first search step;

a second search step for searching the corresponding to each of at least one of the input labels searched by the first search step, and searching, from the output label group, at least one of the output labels on the basis of the searched rule data;

a third search step for searching, from the output belonging degree data group, the data corresponding to at least one of the output labels searched by the second search step;

a second processing step for obtaining weighted data corresponding to the renewal amounts associated with the output labels searched by the second search step, on the basis of the data searched by the third search step and the matching degree found by the first processing step; and a third processing step for calculating a weighted position of the variation amount on the basis of the weighted data corresponding to each of the output labels obtained by the second processing step, thereby inferring the renewal amounts of the factors relating to the image formation conditions; and C) changing the image forming condition on the basis of the inferred renewal amounts of factors of the image forming condition.

By the above structures, the image forming apparatus of the present invention is capable of inferring, by the inference means, the data relating to the image formation conditions which are not easily formulated and are empirically determined, improving the man-machine interface characteristics, and visually confirming the output based on the inference. In addition, even if the inference means is used, the memory capacity for table data is not increased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 21A and 21B show labels qualitatively representing deviations of gradient characteristics as membership functions;

FIGS. 22A and 22B show rule matrixes representing the relationship between the renewal amount of contrast potential and the detected deviation of gradient characteristics, and the relationship between the renewal amount of background voltage and the detected deviation of gradient characteristics;

FIGS. 23A and 23B illustrate the processing sequence for inferring the renewal amount of contrast voltage and renewal amount of background voltage from the rule matrixes;

FIGS. 24A and 24B show specific examples of the detected deviation of high-density region gradient characteristics and detected deviation of low-density region gradient characteristics;

FIG. 25A and 25B show rule matrixes for finding the associated renewal amounts of contrast voltage and background voltage from the specific examples of detected deviations;

FIGS. 26A and 26B illustrate the specific processing sequence for inferring the renewal amounts of contrast voltage and background voltage from the rule matrixes shown in FIGS. 25A and 25B;

DETAILED DESCRIPTION OF THE PREFERRED EMBODIMENTS

Figure 1:
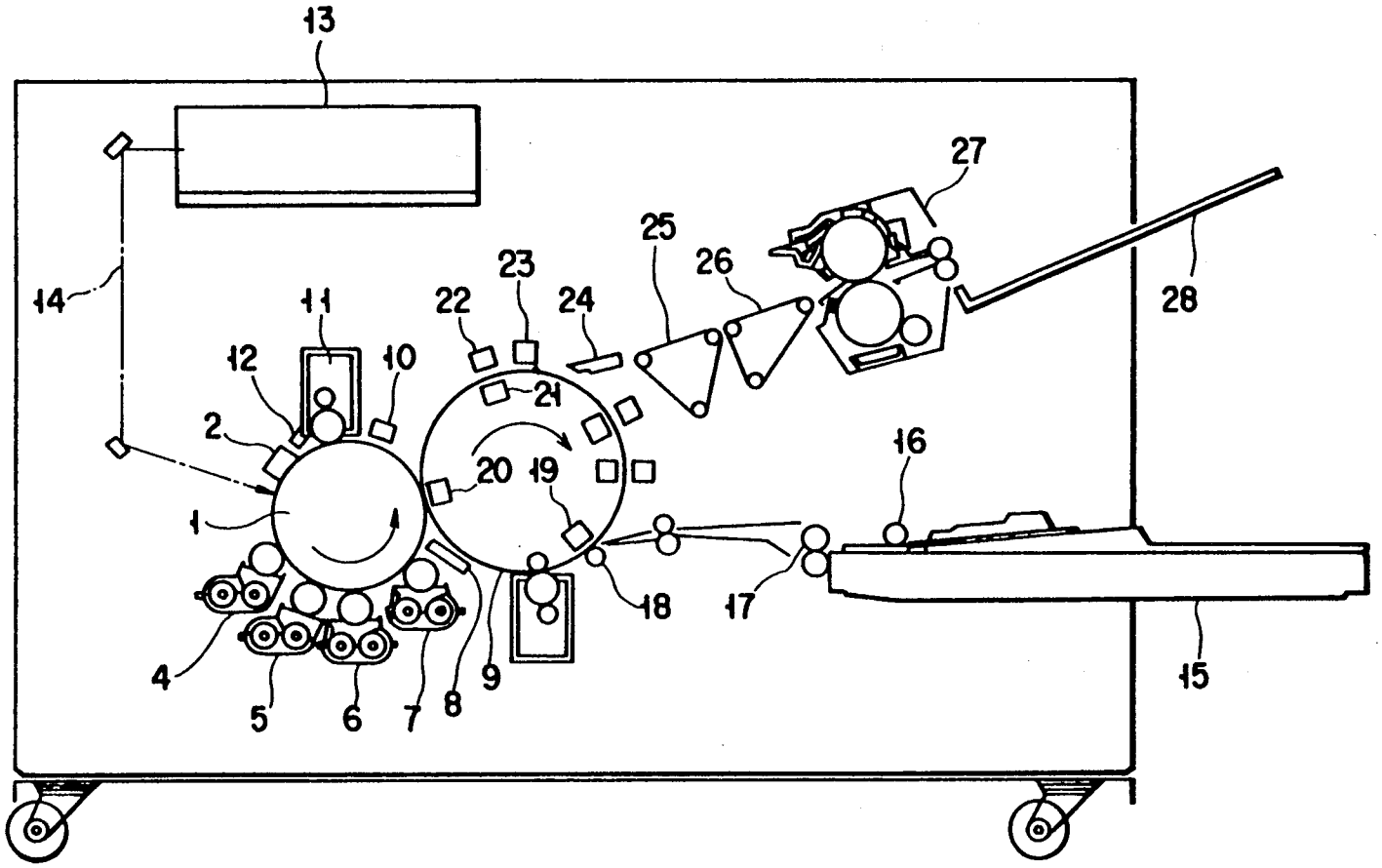
FIG. 1 is a schematic view of a color laser printer embodying an image forming apparatus of the present invention.

FIG. 1 shows the structure of a color laser printer embodying an image forming apparatus according to the present invention. In FIG. 1, a photosensitive drum 1 functioning as image carrying body is rotatable in a counter-clockwise direction in the figure. The photosensitive drum 1 is surrounded by an electrostatic charger 2, a developing means comprising a first developing device 4, a second developing device 5, a third developing device 6 and a fourth developing device 7, a toner adhesion amount measuring unit 8, a transfer drum 9 functioning as transfer material carrying, body, a pre-cleaning de-electrifying device 10, a cleaner 11, and a de-elelctrifying lamp 12, in this order.

The photosensitive drum 1 is rotated in the direction of the arrow in FIG. 1, and the surface of the drum 1 is uniformly charged by the electrostatic charger 2. A laser beam 14 emitted from an optical system 13 functioning as an exposure means is radiated on that part of the surface of the drum 1 which is located between the charger 2 and the first developing device 4. Thus, an electrostatic latent image corresponding to the image data is formed.

The first to fourth developing devices 4 to 7 change the electrostatic latent image on the photosensitive drum 1 corresponding to associated colors into a color toner image. For example, the first developing device 4 is used for development of magenta, the second developing device 5 for development of cyan, the third developing device 6 for development of yellow, and the fourth developing device 7 for development of black.

A transfer paper sheet used as transfer material is conveyed from a paper feed cassette 15 by means of a feed roller 16. The sheet is aligned by register rollers 17 and conveyed to be electrostatically adhered to a predetermined location on the transfer drum 9. The sheet is electrostatically adhered to the transfer drum 9 by means of an adhesion roller 18 and an electrostatic adhesion charger 19. The transfer sheet, while adhered to the transfer drum 9, is conveyed in accordance with clockwise rotation of the transfer drum 9.

The developed toner image on the photosensitive drum 1 is transferred onto the transfer sheet by a transfer charger 20 at a location where the photosensitive drum 1 faces the transfer drum 9. In the case of plural-color printing, a single-rotation cycle of the transfer drum 9 is performed in succession with the respective developing devices, thereby transferring a multi-color toner image onto the transfer sheet in a multiple transfer manner.

The transfer sheet, onto which the toner image has been transferred, is further conveyed in accordance with the rotation of the transfer drum 9 and is de-electrified by a pre-separation inner de-electrification device 21, a pre-separation outer de-electrification device 22 and a separation de-electrification device 23. Thereafter, the sheet is separated from the transfer drum 9 by a separation claw 24 and conveyed to a fixing device 27 by convey belts 25 and 26. The toner on the transfer sheet which is heated by the fixing device 27 is melted. Immediately after the sheet is output from the fixing device 27, the toner image is fixed. The transfer sheet with the fixed image is discharged onto a tray 28.

Figure 2:
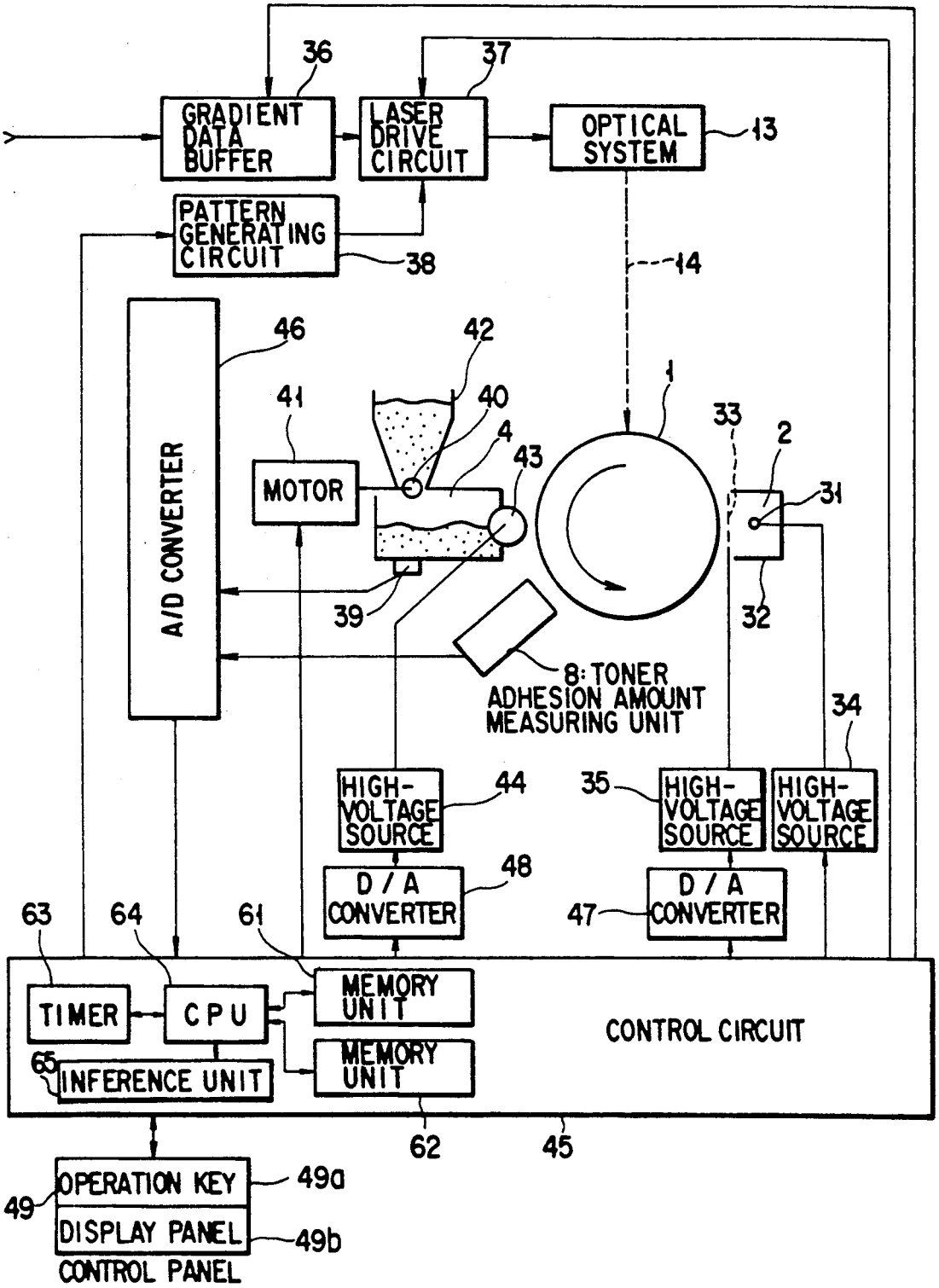
FIG. 2 is a block diagram showing electrostatic charging means, exposure means, developing means, and a control circuit unit including inference means.

FIG. 2 is a block diagram showing an electrostatic charging means, exposure means, developing means and control means in the color laser printer according to this embodiment. The photosensitive drum 1 is rotatable in a counter-clockwise direction in FIG. 2 (the direction of an arrow in FIG. 2). The electrostatic charger 2 comprises a charge wire 3, an electrically conductive case 32 and a grid electrode 33. The charge wire 31 is connected to a corona-generating high-voltage source 34. A corona discharge is applied from the wire 31 to the surface of the photosensitive drum 1, thereby electrostatically charging the drum 1. The grid electrode 33 is connected to a grid-bias high-voltage source 35. The amount of charge to be applied to the surface of the drum 1 is controlled by a grid-bias voltage.

A laser beam 14 is modulated by the optical system 13 and is radiated onto the surface of the drum 1 charged uniformly by the charger 2, thereby forming an electrostatic latent image on the surface of the drum 1. A gradient data buffer 36 stores gradient data fed from an external device or a controller (not shown). In the gradient data buffer 36, gradient characteristics of the printer are corrected, and the gradient data is converted to laser exposure time (pulse width) data.

A laser drive circuit 37 modulates a laser drive current (emission time) in accordance with the data exposure time data fed from the gradient data buffer 36, in synchronism with the scan position of the laser beam 14. A semiconductor laser oscillator (not shown) in the optical system 13 is driven by the modulated laser drive current. Thereby, the semiconductor laser oscillator performs a light emission operation in accordance with the exposure time data.

The laser drive circuit 37 compares an output of a light receiving monitor element (not shown) within the optical system 13 with a preset value. The laser drive circuit 37 produces a drive current to keep the output light amount of the semiconductor laser oscillator at a constant value.

On the other hand, a pattern generating circuit 38 generates gradient data on two different density test patterns of low density and high density for measurement of toner adhesion amount. The pattern generating circuit 38 sends the gradient data to the laser drive circuit 37. The test patterns may be stored in memory units 61.

Of the two test patterns, the test pattern relating to high density is called a high-density test pattern, and the test pattern relating to low density is called a low-density test pattern.

The electrostatic latent image on the photosensitive drum 1 is developed by the first developing device 4. The developing device 4 is, for example, of a two-component development type, and it contains a developing agent consisting of toner and a carrier. The weight % of toner to the developing agent (hereinafter referred to as "toner density") is measured by a toner density measuring unit 39. On the basis of the output of the toner density measuring unit 39, a toner supply motor 41 for driving a toner supply roller 40 is controlled. Thereby, the toner in a toner hopper 42 is supplied to the developing device 4.

A development roller 43 of the developing device 4 is formed of an electrically conductive material and it is connected to a development-bias high-voltage source 44. The roller 43 is rotated with the development bias voltage applied, and toner is adhered to the electrostatic latent image on the drum 1. Thus, the toner image within the developed image area is transferred onto the transfer sheet conveyed by and supported on the transfer drum 9.

The control circuit 45 enables the pattern generating circuit 38 to generate gradient data, when the warmup step is completed after the power is switched ON. Thus, the high-density and low-density gradient patterns for measuring the toner adhesion amount are projected onto the photosensitive drum 1.

The locations on the drum 1 at which the gradient patterns have been projected are developed, and the toner adhesion amount measuring unit 8 measures the toner adhesion amount when the locations with the developed gradient patterns have just come to the position of the measuring unit 8. The output of the measuring unit 8 is converted to a digital signal by an A/D converter 46 and fed to the control circuit.

Figure 3:
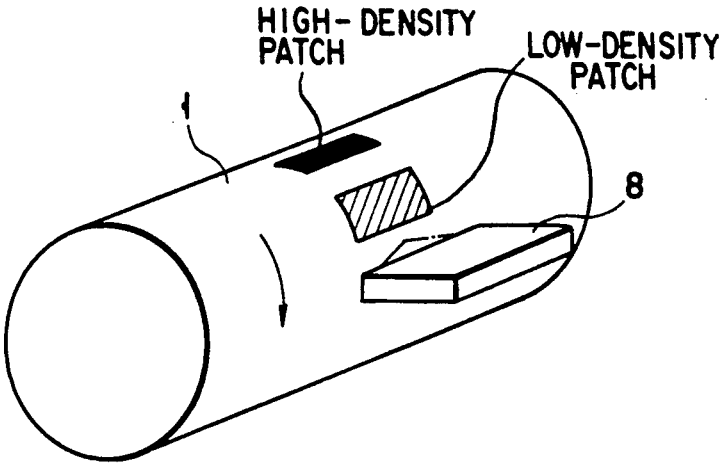
FIG. 3 shows a high-density region developed on a photosensitive drum, which corresponds to high-density gradient data, a low-density region on the drum corresponding to low-density gradient data, and a toner adhesion amount measuring unit.

As is shown in FIG. 3, a test pattern region (high-density patch: high-density region) corresponding to the high-density gradient data and a test pattern region (low-density patch: low-density region) corresponding to the low-density gradient data are formed on the photosensitive drum 1 by the aforementioned development.

The control circuit 45 compares the output (measured value) of the toner adhesion amount measuring unit 8 with a preset reference value, and varies, based on the comparison result, the two factors of the image formation conditions, i.e., the grid bias voltage of the electrostatic charger 2 and the development bias voltage of the developing device 4.

The control circuit 45 controls the switching between the gradient data from the external device or controller (not shown) and the gradient data on the test pattern of the printer and the pattern for toner adhesion amount measurement, receives the outputs from the measuring units 8 and 39, controls the outputs of the high-voltage sources 34, 35 and 44, sets a desirable value of the laser drive current, sets a desirable value of the toner density, controls the supply of toner, and corrects the gradient characteristics of the printer associated with the gradient data.

The high-voltage sources 35 and 44 are controlled by output voltage control signals supplied from the control circuit 45 via D/A converters 47 and 48.

The control circuit 45 comprises a rewritable memory unit 61 constituted by an EEPROM or the like, the data of which is not erased even if the power is turned off, a memory unit 62 constituted by a data storing RAM or the like, a timer 63 for measuring a wait time or the like, a CPU 64 for controlling the entire control circuit 45, and an inference unit 65 for inferring the contrast voltage on the basis of a deviation of the high-density region and a deviation of the low-density region and inferring the background voltage on the basis of a deviation of the high-density region and a deviation of the low-density region. The inference unit 65 may be constituted as hardware, or as software in a CPU.

Various set values are stored in the memory unit 61 in advance. For example, the memory unit 61 stores, for example, an initial grid bias voltage value and an initial development bias voltage value both corresponding to the bias conditions representing the standard gradient characteristics at normal temperature and normal humidity, test pattern gradient data (the high-density region and low density region), a preset desirable value of the toner adhesion amount of the high-density region (used in finding the deviation), a preset desirable value of the toner adhesion amount of the low-density region (used in finding the deviation), a control standard value associated with the deviation of the high-density region, a control standard value associated with the deviation of the low-density region, a coefficient representing surface potential characteristics, a predetermined number of sheets to be printed, a predetermined elapsed time, a maximum number of times of control, bias condition values, an abnormal range of the toner adhesion amount measuring unit 8, and upper and lower limit values (predetermined ranges) of a reflected light amount of a region other than the test pattern region, a reflected light amount of the high-density region and a reflected light amount of the low-density region.

The bias condition values include upper and lower limit values (predetermined ranges) of the grid bias and development bias, and values of a predetermined range within which a difference voltage between the grid bias and development bias should fall.

The desired value of the high-density region and the desired value of the low-density region can be varied and/or displayed by operating the control panel 49. The control panel 49 comprises an operation key 49*a* and a display panel 49*b*.

The memory unit 61 also stores an inference program used in the inference unit 65, an input label group, input belonging degree data, an output label group, output belonging degree data, and inference data (such as rules). The contents of the inference data can be varied by operating the control panel 49.

The memory unit 62 stores a bias value (at the time of setting the bias renewing code) set before the toner adhesion amount measuring unit 8 becomes abnormal, a counter for counting the number of sheets to be printed, a sensor abnormal flag to be turned on when the toner adhesion amount measuring unit 8 is abnormal, and a toner empty flag to be turned on when the toner is empty.

Figure 4:
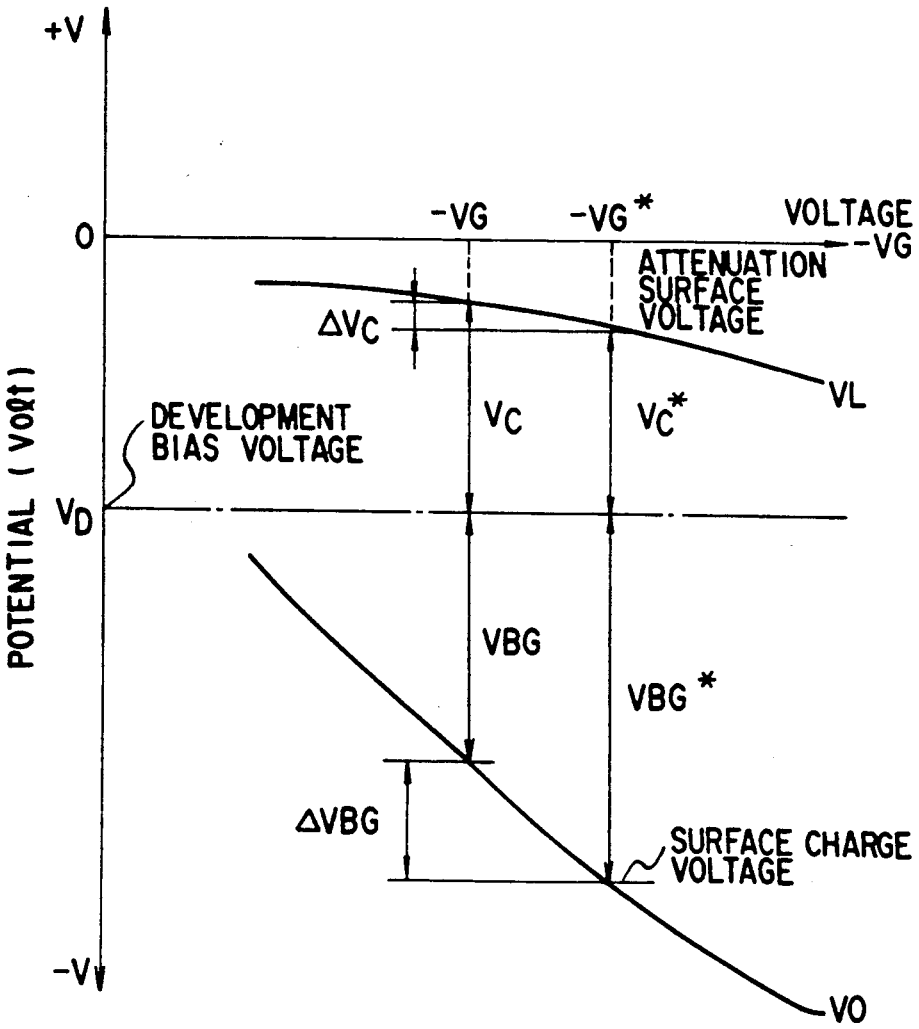
FIG. 4 shows a non-exposed region potential and an exposed region potential of a photosensitive drum in relation to a grid bias voltage of the charger, and a development bias voltage.

FIG. 4 shows a surface potential (hereinafter called "non-exposed region potential") VO of electricity charged uniformly on the photosensitive drum 1 by the electrostatic charger 2 and a surface potential (hereinafter "exposed region potential") VL of the photosensitive drum 1, which is attenuated by a predetermined amount of exposure light radiated to the entire surface of the drum 1 by the optical system 13, in relation to an absolute value VG (hereinafter "grid bias voltage") of a bias voltage applied to the grid electrode 33 of the charger 2 shown in FIG. 2, and a development bias voltage VD (dot-and-dash line).

In this embodiment, the polarity of the voltage is negative due to an inversion phenomenon. As the grid bias voltage VG increases, the absolute values of the non-exposed region potential VO and exposed region potential VL decrease. The exposed region potential VL and non-exposed region potential VO can be linearly approximated in relation to the grid bias voltage VG, as given by the following equations:

$$VO(VG)=K1\cdot VG+K2 \quad (1)$$

$$VL(VG)=K3\cdot VG+K4 \quad (2)$$

where

K1 to K4 are constants,

VO, VG and VL are absolute values, and

VO(VG) and VL(VG) are the magnitudes of VO and VL in relation to a given value of VG.

The development density varies in accordance with the relationship between the absolute value VD of development bias voltage, the exposed region potential VL and the non-exposed region potential VO. The contrast voltage VC and background voltage VBG are defined by $$VC=VD(VG)-VL(VG) \quad (3)$$

$$VBG=VO(VG)-VD(VG) \quad (4)$$

where VD (VG) represents the magnitude of VD in relation to a given value of VG.

Figure 5:
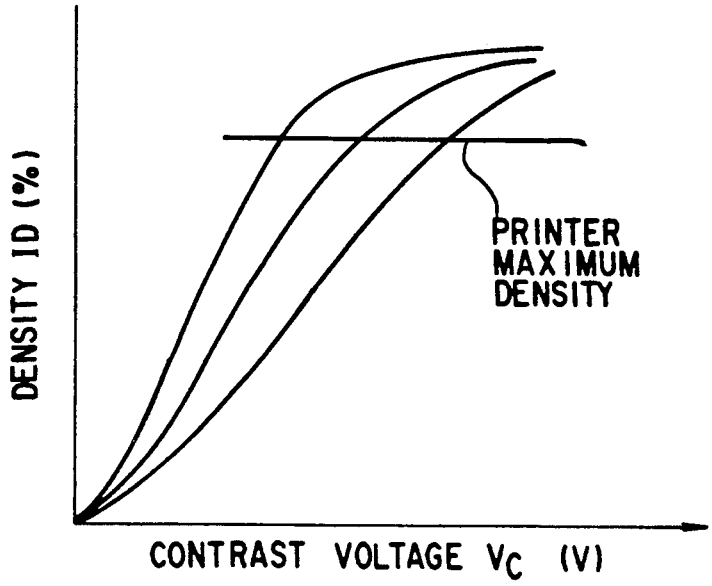
FIG. 5 shows the image density of a black region in relation to a contrast voltage.
Figure 6:
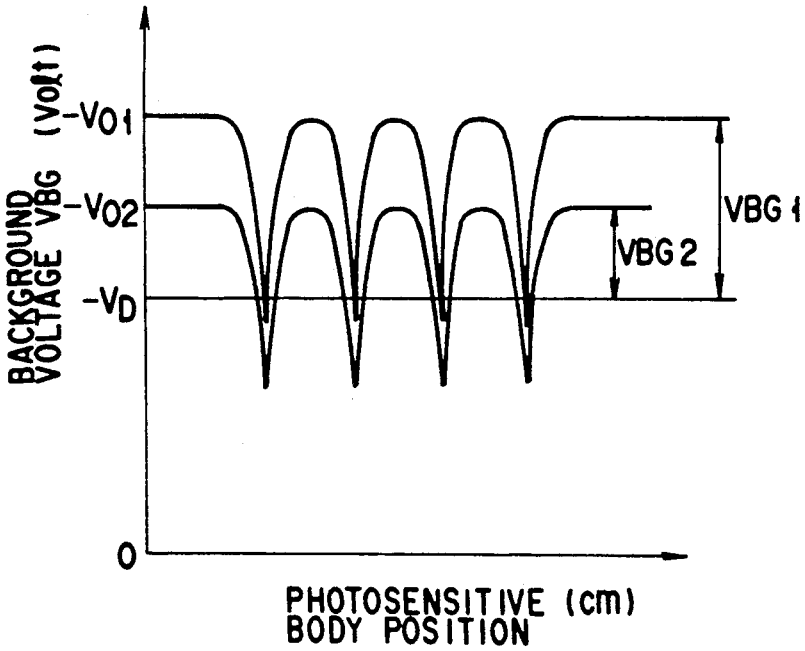
FIG. 6 shows the relationship between a non-exposed region potential on a photosensitive drum surface, a voltage relating to a low-density pattern, and a development bias voltage.

The contrast voltage VC relates particularly to the density of a black area (see FIG. 5) and the background voltage VBG relates particularly to the density of the low-density region in a multi-gradient system using pulse width modulation (see FIG. 6).

Figure 7:
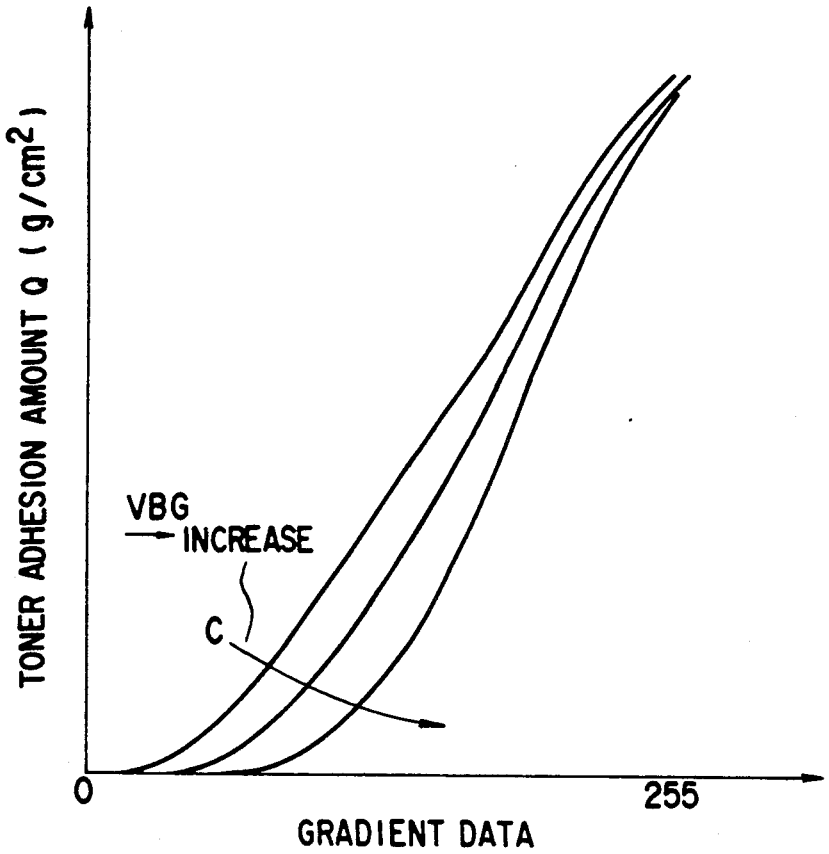
FIG. 7 shows the toner adhesion amount in relation to the gradient data when the background voltage is increased.

FIG. 7 shows the toner adhesion amount Q in relation to the gradient data when the background voltage VBG is increased. The low-density region varies in the direction of arrow C in FIG. 7. Accordingly, the development density can be varied by the contrast voltage VC and background voltage VBG.

The following equations (5) and (6) are obtained from equations (1) to (4):

$$VG(VC, VBG)=(VC+VGG-K2+K4)/(K1-K3) \quad (5)$$

$$VD(VBG, VG)=K1\cdot VG+K2-VBF \quad (6)$$

From equations (5) and (6), the contrast voltage VC and background voltage VBG are determined when the relationship (K1 to K4) between the exposed-area potential VL and non-exposed-area potential VO, on the one hand, and the grid bias voltage VG, on the other hand, is well known. Thus, the grid bias voltage VG and development bias voltage VD can be determined definitely.

The surface potential of the photosensitive drum 1 is measured in advance, and the relationship (K1 to K4) between the exposed-area potential VL and non-exposed-area potential VO, on the one hand, and the grid bias voltage VG, on the other hand, is found. Thereafter, the contrast voltage VC and background voltage VBG are set. From equations (5) and (6), the grid bias voltage VG and development bias voltage VD are determined definitely. Under this condition, a plurality of density patterns are formed, and the toner adhesion amount Q is measured after these patterns have been developed. The measured value is compared with a preset reference value. From deviation ΔQ, the correction values ΔVC and ΔVBG of the contrast voltage VC and background voltage VBG in relation to the optimal development density are inferred. From the inference result, the grid bias voltage VG and development bias voltage VD are set once again, and the toner adhesion amount of the density pattern is measured. Until the toner adhesion amount falls within an allowable range, this operation is repeated.

The toner adhesion amount measuring unit 8 will now be described in greater detail.

Figure 8:
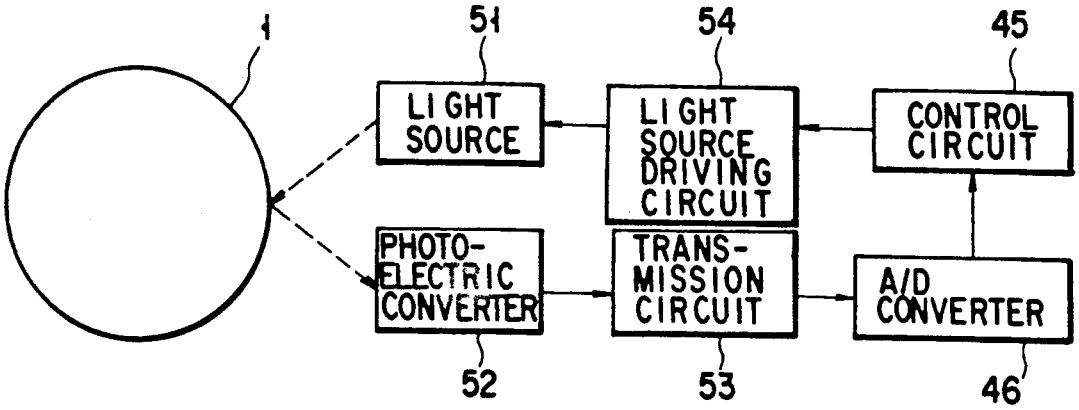
FIG. 8 is a block diagram showing the structure of toner adhesion amount measuring unit 8 shown in FIGS. 1, 2 and 3.

FIG. 8 shows the structure of the toner adhesion amount measuring unit 8. In FIG. 8, a beam from a light source 51 is radiated on the surface of the photosensitive drum 1. The beam reflected by the drum 1 or the developed adhered toner is converted by a photoelectric converter 52 to an electric current corresponding to the light amount of the reflected beam. The current is converted to a voltage signal, and the voltage signal is fed to an A/D converter 46 via a transmission circuit 53. The voltage signal is converted to a digital signal by the A/D converter 46 and the digital signal is input to the control circuit 45.

The light source 51 is driven by a current from a light source driving circuit 54. The circuit 54 is turned on/off by the control circuit 45, or by a signal for regulating a current amount of a driving current to the light source 51.

Figure 9A:
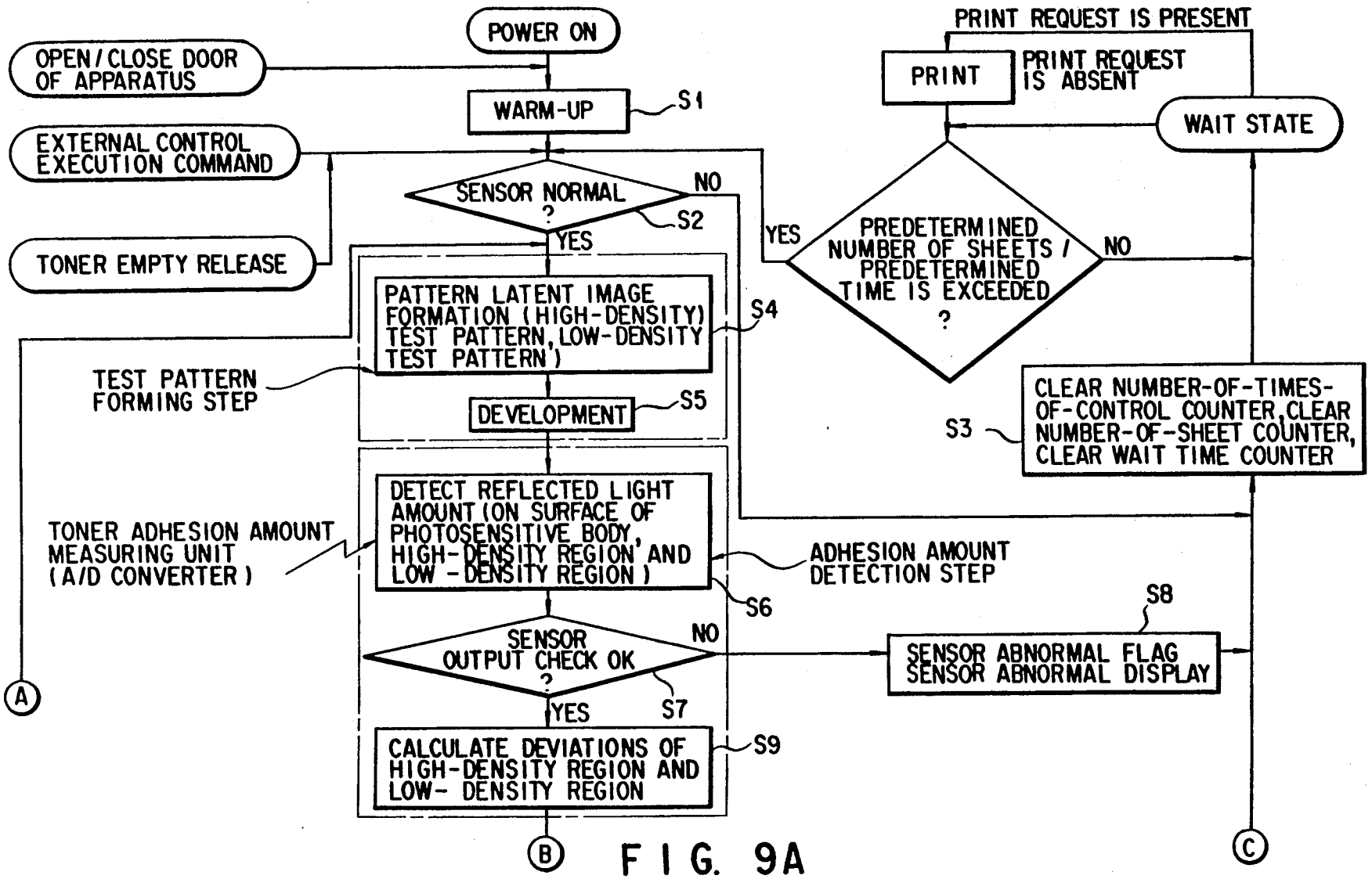
FIGS. 9A and 9B are flow charts illustrating the processing operation in the bias renewing mode.
Figure 9B:
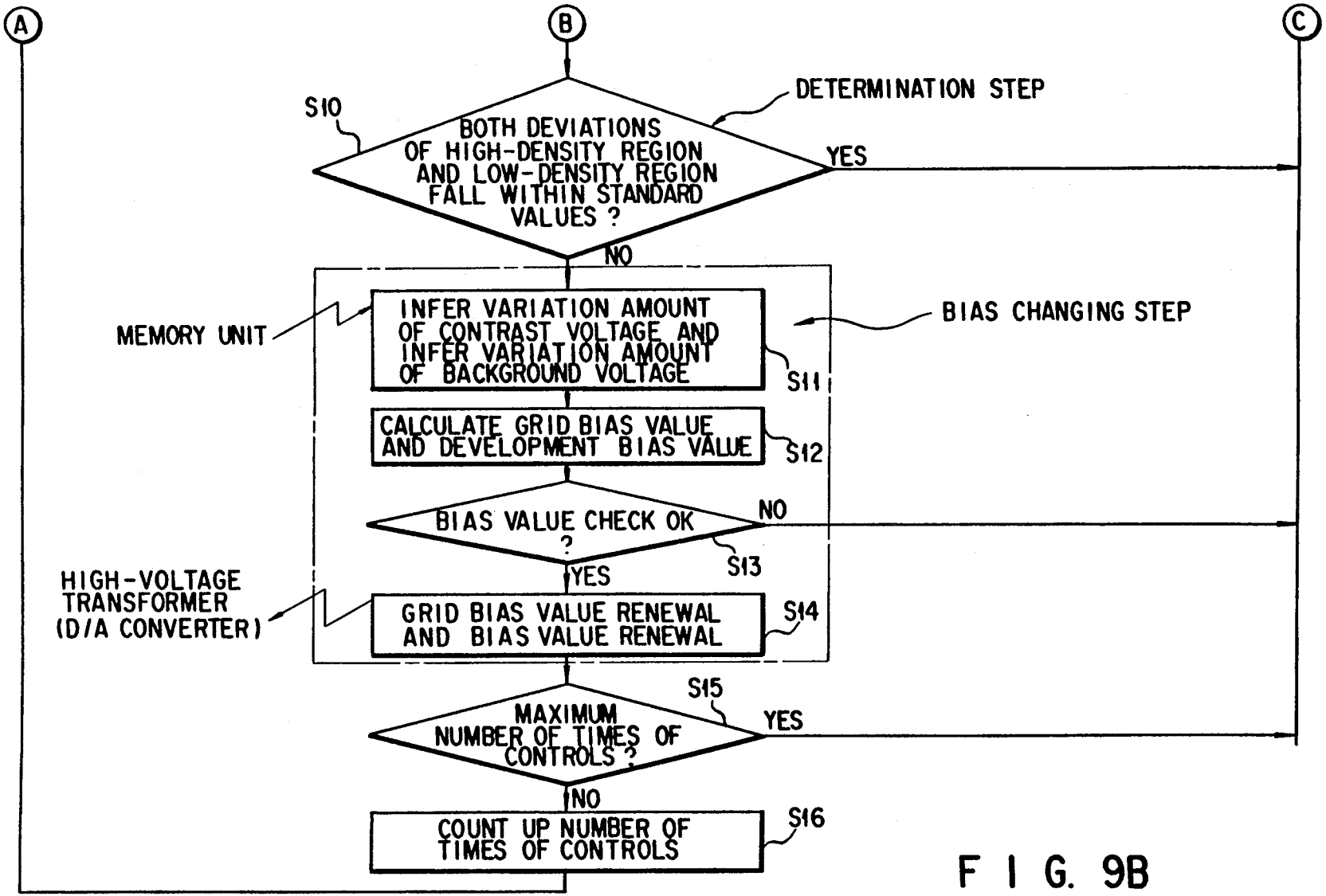

The operation in the bias renewing mode with the above structure will now be described with reference to FIGS. 9A and 9B.

The bias renewing mode comprises a warm-up step, a test pattern forming step, an adhesion amount detection step, a determination step, and a bias changing step.

In the warm-up step (step S1), power is supplied to the apparatus, and the CPU 64 in the control circuit 45 performs initial processing and executes preset sequences of initial operations. In particular, time is required for the warm-up of the fixing device 27. Initial operations of the image forming system, including a cleaning operation, is performed the moment the warm-up has been completed or the temperature has reached a predetermined value lower than a predetermined target value for completion of warm-up.

In the initial operations, the temperature of the photosensitive drum 1, the humidity in the apparatus, the stirring condition of the developing agent, and characteristics of the drum 1 associated with the charging/deelectrification are stabilized, and the drum 1 is cleaned. Thereby, the apparatus is set in the same image forming state as normal image forming state (printing based on user's image data).

After the warm-up step, the CPU 64 determines whether or not the toner adhesion amount measuring unit 8 is normal. Specifically, on the basis of the result of the sensor output check in the adhesion amount detection step, the presence/absence of the sensor abnormal flag is confirmed (step S2). (At the time of power ON, the normal state is determined since the flag is cleared.)

As a result, when the abnormal state of the toner adhesion amount measuring unit 8 is determined, the CPU 64 is set in the stand-by state in the state in which the high voltage sources 35 and 44 can be controlled by the initial grid bias voltage value and initial development bias voltage value corresponding to the bias conditions associated with the reference gradient characteristics at normal temperature and normal humidity stored in the memory unit 61. Specifically, the output voltage control signals, to which the initial grid bias voltage value and initial development voltage value read out from the memory unit 61 have been converted by the D/A converters 47 and 48, are supplied to the high voltage sources 35 and 44. Thereby, the high voltage sources 35 and 44 have the grid bias voltage value and development bias voltage value.

In this case, a number-of-control-times counter and a number-of-printing-sheets counter in the CPU 64 and memory unit 62 and a timer 63 for counting a stand-by time are cleared (step S3).

When the normal state of the toner adhesion amount measuring unit 8 is determined, the CPU 64 is set in the bias renewing mode, and the test pattern forming step is initiated (step S4). In this case, the CPU 64 stores in the memory unit 62 the grid bias voltage value and development bias voltage value set currently by the high voltage sources 35 and 44 (reference values at the time of power ON; otherwise bias values are set before the abnormal state of the toner adhesion amount measuring unit 8 is set).

In the test pattern forming step (step S4), after the completion of initial operations, the processes for electrostatic charging, exposure, development, cleaning and de-electrification are performed like the normal image forming operation sequence, and the image forming operation associated with the high-density test pattern and low-density test pattern generated from the pattern generating circuit 38 is executed.

At this time, the grid bias voltage value of the electrostatic charger 2 and the development bias voltage value of the developing device 4 are set at predetermined values. These values are employed as bias conditions for reference gradient characteristics at normal temperature and normal humidity.

Specifically, in this operation, the CPU 64 reads out from the memory unit 61, output voltage control signals as initial grid bias voltage value and initial development bias voltage value, and supplies the readout signals to the high voltage sources 35 and 44 via the A/D converters 47 and 48.

In the exposure process, two test pattern latent images of predetermined sizes corresponding to predetermined two different gradient data elements are formed. Of the test patterns corresponding to the two gradient data elements, the pattern with higher density is employed as high-density test pattern, and the pattern with lower density is employed as low-density test pattern.

The test pattern has a predetermined axial length, and extends from a center image region on the photosensitive drum 1. It also has a predetermined circumferential length on the drum 1. The predetermined width corresponds to an axial position of the toner adhesion amount measuring unit 8 on the photosensitive drum 1, i.e. a minimum size such that the area of a detection spot is not affected by the edge effect peculiar to electrophotography. In addition, the predetermined length is a minimum length such that the detection result is not affected by the edge effect or response characteristics of the sensor.

In this embodiment, the predetermined width is 1.5 to 5 mm greater than the detection spot size. The predetermined length has a value obtained by multiplying the detection spot size with a length of movement for four times the time of a single sensor time constant and the number of times of detection operations, and adding 1.5 to 5 mm to the multiplied value.

In the development process, two test pattern latent images are developed by the development roller 43 to which an initial development bias voltage is applied, and, as shown in FIG. 3, two test pattern toner images with different densities are formed (step S5). Of the two test patterns, the test pattern region corresponding to the low-density gradient data is referred to as a low-density region, and the test pattern region corresponding to the high-density gradient data is referred to as a high-density region.

In the adhesion amount detection step, the toner adhesion amount measuring unit 8 detects the reflection light amount of each test pattern at the timing at which the two test patterns have come to the position facing the toner adhesion amount measuring unit 8 (step S6). In addition, the toner adhesion amount measuring unit 8 also detects the reflection light amount on the non-developed region on the photosensitive drum 1 at a predetermined timing.

The data on the reflection light amount on the non-developed region of the photosensitive drum 1, the reflection light amount on the low-density region on the drum 1 and the reflection light amount on the high-density region on the drum 1, which have been detected by the toner adhesion amount measuring unit 8, are supplied to the CPU 64 via the A/D converter 46. The CPU 64 compares, with the upper limit values and lower limit values (a predetermined range) read out from the memory unit 61, the reflection light amount on the non-test pattern region, the reflection light amount on the low-density region and the reflection light amount on the high-density region supplied from the A/D converter 46 (step S7).

If any one of the reflected light amounts is found, by comparison, to be out of the normal range, the CPU 64 determines that the output value of the toner adhesion amount measuring unit 8 is abnormal. In this case, the CPU 64 sets a sensor abnormal flag in the memory unit 62 and enables the display unit of the control panel 49 to show that the output value of the measuring unit 8 is abnormal (step S8). The bias value prior to the initiation of the bias renewing mode is read out from the memory unit 62, and the high voltage sources 35 and 44 are controlled by output voltage control signals corresponding to the read-out bias voltage values. Then, the CPU 64 is set in the stand-by state.

When the output value of the toner adhesion amount measuring unit 8 is normal, the CPU 64 determines, as the toner adhesion amounts of low-density and high-density regions, the calculation results of predetermined functions relating to the light reflectance on the low-density and high-density regions, on the basis of the data on the reflection light amount on the non-developed region supplied from the A/D converter 46.

Then, the CPU 64 compares predetermined target values stored in the memory unit 61 with the determined toner adhesion amounts on the high-density region and low-density region, thereby calculating deviations of the high-density region and low-density region (step S9).

In the next determination step, the CPU 64 determines whether the calculated deviations on the high-density region and low-density region fall within the range of predetermined standard values stored in the memory unit 61 (step S10). If both the calculated deviations on the high-density region and low-density region fall within the range of predetermined standard values, the number-of-control-times counter and the number-of-printing-sheets counter in the memory unit 62 and the timer 63 for counting the wait time are cleared. Thus, the CPU 64 is set in the wait state (in which printing can be started upon request by the user).

When at least one of the deviations is not within the range of standard values, the control routine advances to the bias changing step. In the bias changing step, the grid bias voltage value and development bias voltage value to be varied are found in order to make both the deviations on the high-density region and low-density region fall within the range of predetermined standard values.

The bias changing step comprises three sub-steps:

(1) Step of determining the renewal amount for the potential relationship expressed by two parameters on the basis of the relationship between both deviations (step S11);

(2) Step of calculating bias values to be varied, on the basis of the varied potential relationship and preset functions, including a coefficient representing the surface potential characteristics of the photosensitive drum 1 (step S12); and (3) Step of checking whether or not the calculated bias values are correct (step S13) and, if the calculated bias values are not correct, setting the apparatus in the wait state, and, if the calculated bias values are correct, setting a grid bias variation value and a development bias variation value calculated at a predetermined timing (step S14).

It is determined whether the number of times of control operations has reached a maximum value at the time of varying the bias values (step S15). If it has reached the maximum value, the apparatus is set in the wait state, and if not, the number of times of controls is counted (step S16) and the control routine returns to the pattern forming step.

In such a case, there is a problem with a method in which the development bias voltage value and grid bias voltage value are selected from a preset table, directly on the basis of the deviations of the high-density region and low-density region. Suitable bias renewal amounts vary due not only to ambient influences but also time-based variations in development characteristics resulting from the photosensitive drum 1, use of developing agent, past record of non-use state, and differences between individual apparatuses. Because of time-based variations, convergent values in the case of repetitive detection operations may depart from target values.

The effects of potential variations on the high-density region and low-density region are not always independent but may have a correlation. Thus, it is contradictory to determine the bias values from the deviations.

(1) The image forming apparatus of the present invention includes inference unit 65 as inference means for inferring variation amounts of the potential relationship expressed by two parameters, on the basis of the relationship between the deviation of the high-density region and the deviation of the low-density region.

In this case, one of the parameters is the contrast voltage representing a difference voltage between the exposed-area potential or the surface potential of the development position caused by total-surface exposure with a predetermined amount of exposure light, and the development bias potential. The other parameter is the background voltage or the voltage between the non-exposed-area potential or the surface potential at the development location which is charged but not exposed thereafter, and the development bias potential. The variation in contrast voltage increases towards the high-density region, and the variation in background voltage increases towards the low-density region.

Figure 10:
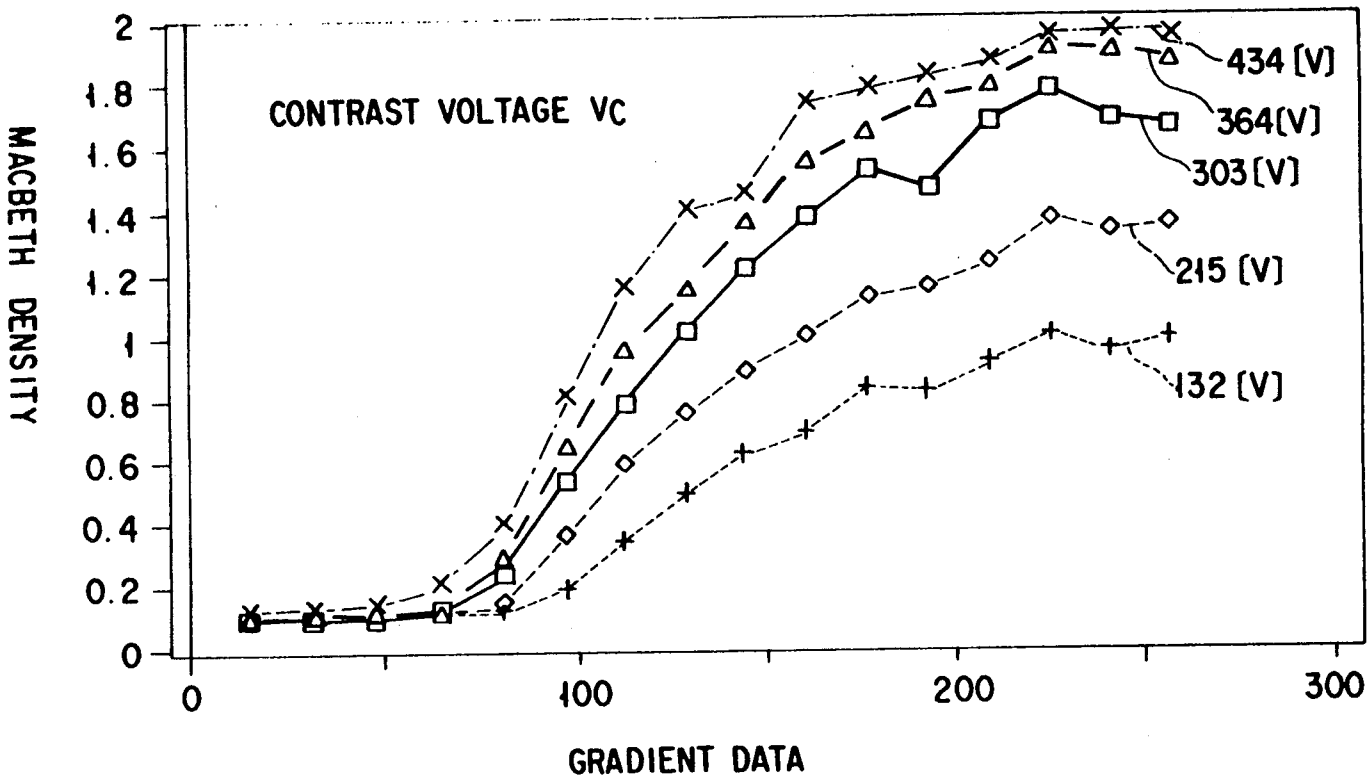
FIG. 10 shows the variation of gradient characteristics when the contrast voltage is renewed.
Figure 11:
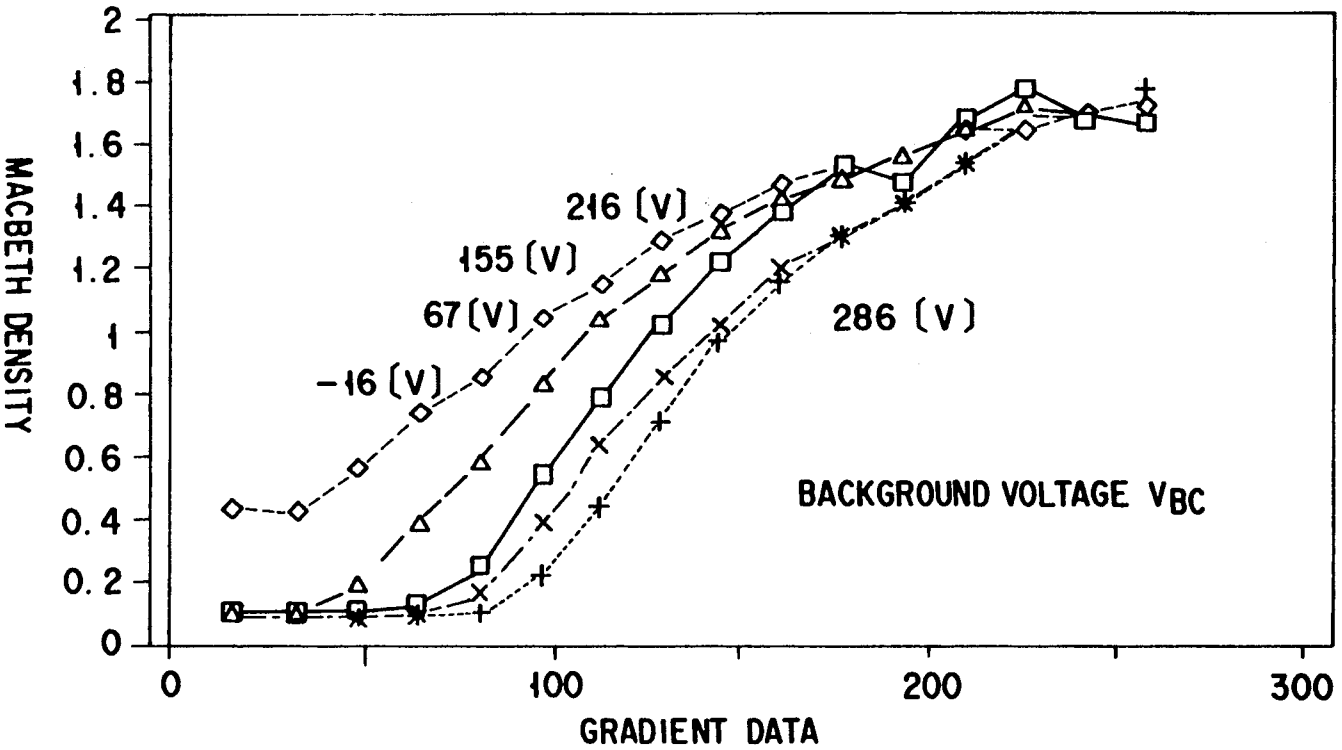
FIG. 11 shows the variation of gradient characteristics when the background voltage is renewed.

FIG. 10 is a graph showing gradient data in the horizontal axis and an output image density in the vertical axis. This graph shows the variation in gradient characteristics in the case where the contrast voltage has been varied. Similarly, FIG. 11 is a graph showing the variation in gradient characteristics in the case where the background voltage has been varied. The variations of contrast voltage and background voltage, however, act on the high-density region and low-density region, respectively, in a correlated manner.

Accordingly, the inference unit 65 is provided to infer the contrast voltage renewal amount from the relationship between the deviations of the high-density region and low-density region, and infer the background voltage renewal amount from the relationship between the deviations of the high-density region and low-density region, on the basis of the inference data in the memory unit 61. Thereby, the contrast voltage renewal amount and background voltage renewal amount are found from the deviations of the high-density region and low-density region.

The rules used in each inference operation are determined in consideration of the interaction of the contrast voltage and background voltage. On the basis of the relationship between both deviations, the contrast voltage and background voltage can be suitably varied. In addition, since each renewal amount is zero when both deviations are zero, the constant deviation after convergence approaches to zero.

(2) New contrast voltage and new background voltage are determined on the basis of the obtained contrast voltage renewal amount and background voltage renewal amount and the contrast voltage and background voltage at the time of test pattern formation.

Since these values are parameters representing the voltage relationships, the grid bias voltage value and development bias voltage value to be set are calculated in order to realize the voltage relationships.

The grid bias voltage value and development bias voltage value can be definitely calculated, based on the functions (see above equations (5) and (6)) preset in the memory unit 61, including coefficients representing the surface potential characteristics of the photosensitive drum 1.

(3) The obtained new grid bias voltage value and development bias voltage value are employed to renew the output control values of the high voltage sources 35 and 44.

When the grid bias voltage value and development bias voltage value are renewed to form test patterns, these values are renewed at predetermined timing.

Regarding the predetermined timing, the development bias is varied, at least, in synchronism with the time a predetermined position on the photosensitive drum 1, the grid bias for which has been varied, comes to the development position. If the renewal timing is freely chosen, fogging or smearing may occur on the photosensitive drum 1 due to carrier adhesion in two-component development.

Figure 12:
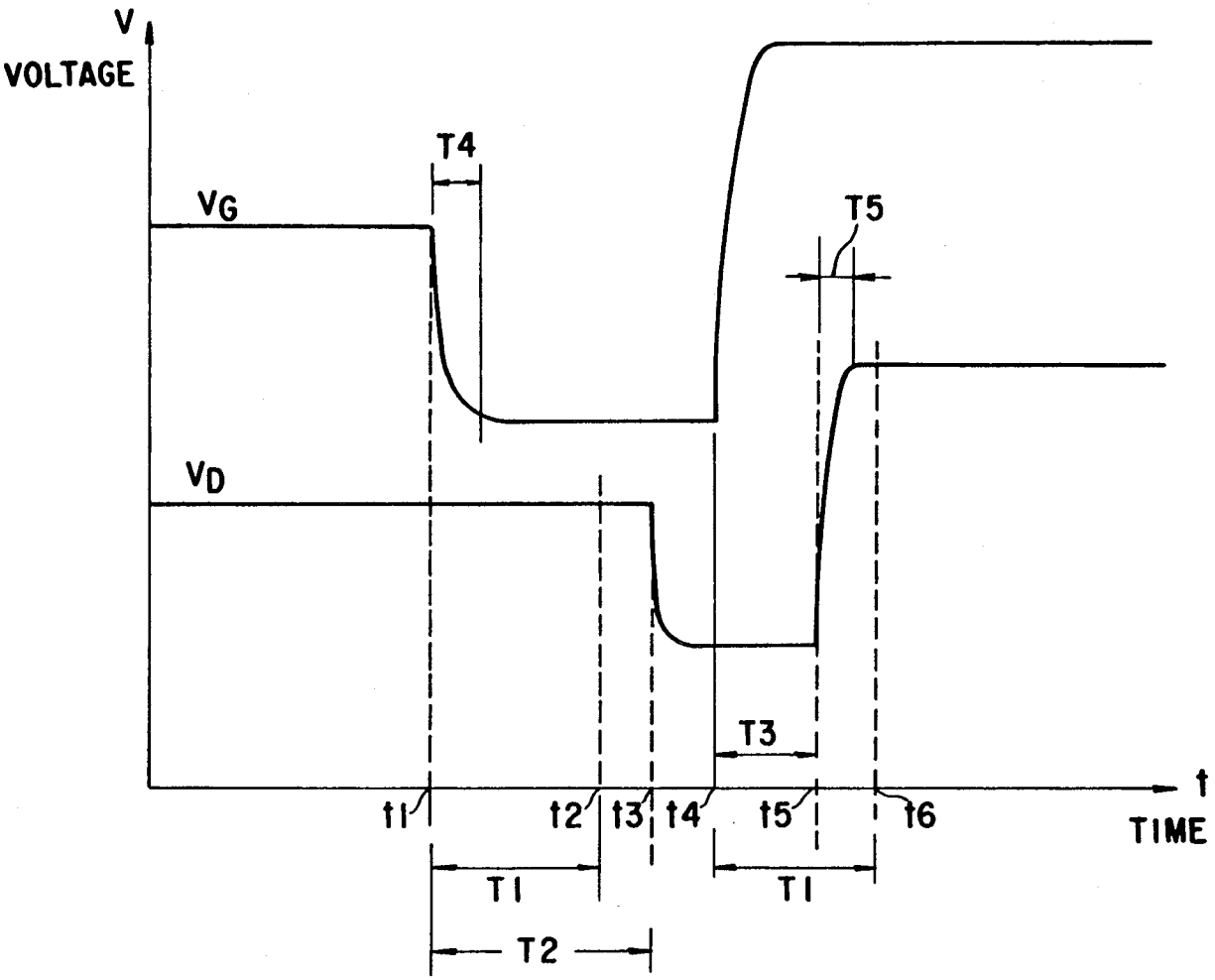
FIG. 12 is a graph showing the timing for renewing the grid bias and development bias.

FIG. 12 shows the renewal timing of the grid bias and development bias in this embodiment. According to this embodiment, when the grid bias voltage is lowered to prevent carrier adhesion, the development bias value is renewed at time t3. The time t3 is after grid bias value renewal time t1 by time T2. Time T2 is longer than the total time of delay time T4 of charge potential variation due to delay of grid bias high voltage source 35 or other cause and time T1 for movement between the grid electrode 33 and the development position of the photosensitive drum 1.

When the grid bias voltage is increased, the development bias voltage value is renewed at time t5. The time t5 is after grid bias voltage value renewal time t4 by time T3. Time T3 is shorter than the time obtained by subtracting delay time T5 of development bias high voltage source 44 from time T1 for movement between the grid electrode 33 and the development position of the photosensitive drum 1.

Specifically, the background voltage at the same location on the photosensitive drum 1 is prevented from increasing at the time of renewal, thereby preventing the carrier to adhere to the photosensitive drum 1.

However, if the difference between T2, T3 and T1 is increased too much, the degree of fogging on the drum 1 may increase. Thus, in the embodiment, when T4=50 msec or less and T5=50 msec or less, it is determined that T2−T1=200 msec or less and T1−T3=200 msec or less.

Next, the formation, detection and determination of the test patterns are performed once again. Two test pattern latent images are formed by exposure on the photosensitive drum 1 which is electrostatically charged by the renewed grid bias voltage. Further, the two test patterns developed with the renewed development bias voltage are subjected to the adhesion amount detection step and the determination step.

In the determination step, if the deviation of the high density region and the deviation of the low-density region fall within the range of standard values, the renewed grid bias voltage value and development bias voltage value are retained, and, after cleaning, the apparatus is set in the wait state. If at least one of the deviations does not fall within the range of standard values, the bias is renewed and the steps of pattern formation, detection and determination are repeated.

Next, the qualitative algorithm will now be explained.

In this embodiment, in the step of deriving the variation amounts of two potential relationships from the deviations of the high-density region and low-density region in the bias changing step, when both deviations have positive values, the contrast voltage is mainly decreased. When both deviations have negative values, the contrast voltage is mainly increased. When the deviation of the high-density region is within the range of standard values near zero and the deviation of the low-density region has a negative value, the background voltage is decreased. When the deviation of the high-density region is within the range of standard values near zero and the deviation of the low-density region has a positive value, the background voltage is increased. The reason is that highly effective voltage relationships are realized by the effects of the contrast voltage and these background voltage and are principally employed.

Aforementioned FIG. 10 shows the effects of the contrast voltage variation on the gradient characteristics.

The horizontal axis indicates the gradient data and the vertical axis indicates the output image density. When the contrast voltage increases, the high-density-side density increases with a greater gradient.

Aforementioned FIG. 11 shows the effects of the background voltage variation on the gradient characteristics.

It is understood that when the background voltage is increased, the development beginning of the low-density region shifts to the higher gradient data side with a greater gradient.

It is understood, from FIGS. 10 and 11, even if the variation amount of the background voltage is small, as compared to the variation amount of the contrast voltage, the effect on the gradient characteristics is high. Further, there is a concern that fogging occurs on the photosensitive drum 1, reversely charged toner may adhere to the drum 1, or carrier adhere to the drum 1 in the case of two-component developing agent. Thus, the background voltage is not largely varied, and mainly the high-density region is roughly adjusted on the basis of the contrast voltage, and the high-density region as well as low-density region is finely adjusted on the basis of the contrast voltage and background voltage.

Qualitative rules are prepared, in consideration of the above, to find the variation amounts for varying the above potential relationships, and the rules are stored in the memory unit 61.

Figure 13:
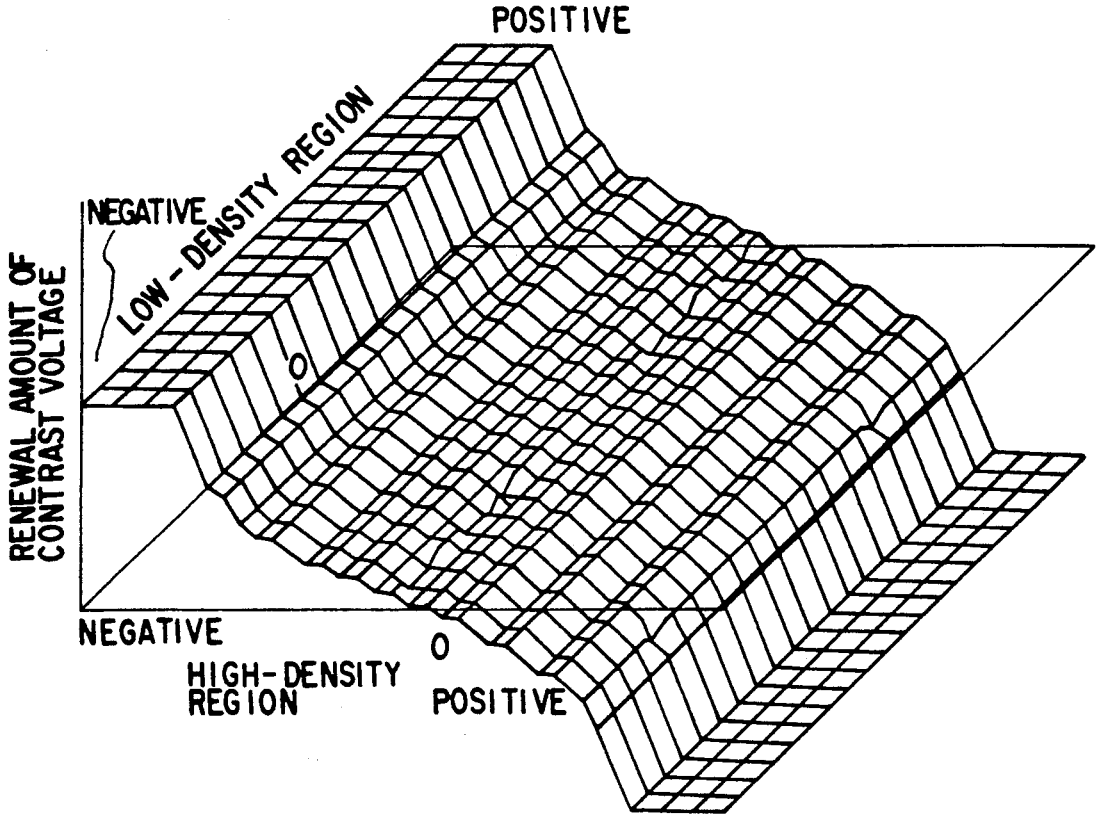
FIG. 13 shows the contents of the table relating to the renewal amount of contrast voltage.

FIG. 13 shows the contents of the inference result of the inference unit 65 relating to the renewal amount of the contrast voltage. The horizontal axis indicates the deviation of the high-density region, the depth axis indicates the deviation of the low-density region, and the vertical axis indicates the contrast voltage. Both deviations of the high-density region and low-density region are zero at the center of the frame in a plane defined by the deviation axis of the high-density region and the deviation axis of the low-density region. In other words, the toner adhesion amount on the high-density region and the toner adhesion amount on the low-density region meet their respective target values. In this embodiment, the renewal amount of the contrast voltage hardly depends on the deviation of the low-density region.

Figure 14:
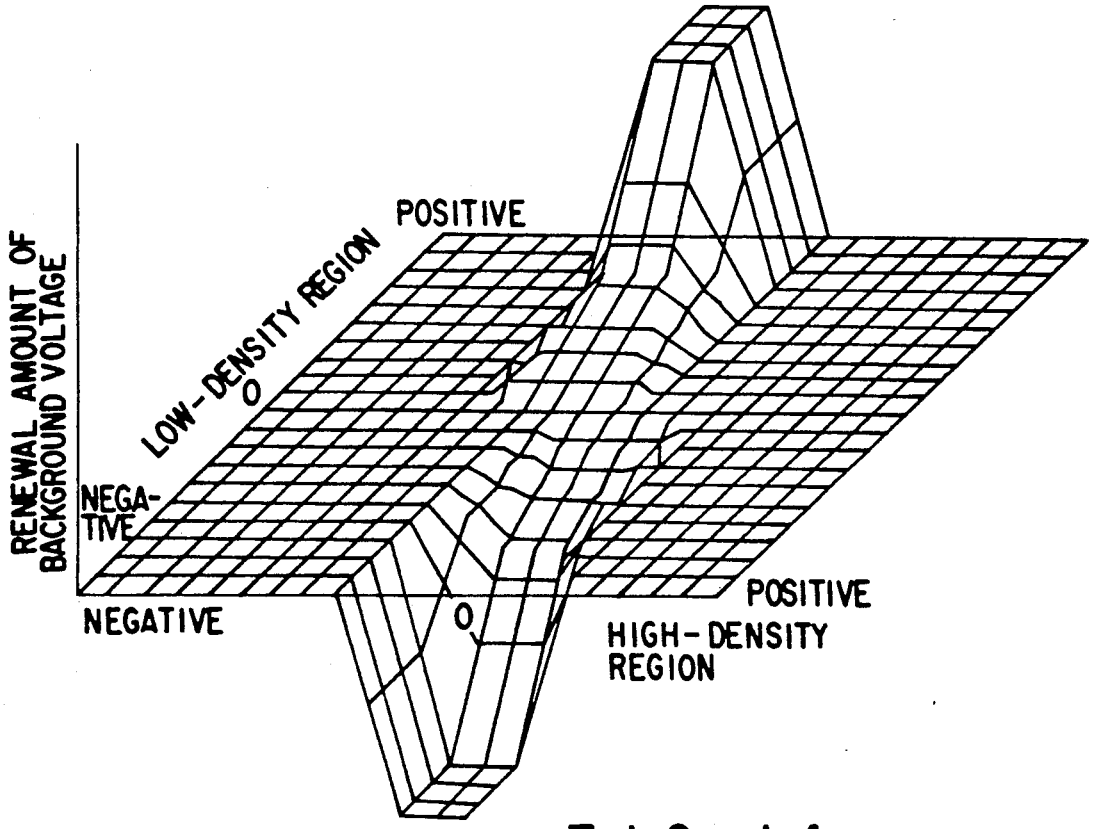
FIG. 14 shows the contents of the table relating to the renewal amount of background voltage.

FIG. 14 shows the contents of the inference result of the inference unit 65 relating to the renewal amount of the background voltage. With the same expression as in FIG. 13, when the deviation of the high-density region departs largely from zero, the renewal amount of the background voltage is zero, i.e., the background voltage is not varied. Only when the deviation of the high-density region is near zero, the background voltage is varied.

In the case where the renewal amounts of the contrast voltage and background voltage are determined from the relationship between the deviations of the low-density region and high-density region and thereby the operation renewal amount for each deviation is determined independently, it is possible that the renewal amount of the background voltage, in particular, is erroneously determined. However, even if one of the deviations is the same and the other deviation is different, the optimal operation amount can be determined by the parameter renewal amount suitable for the effect of the operation amount.

Figure 15:
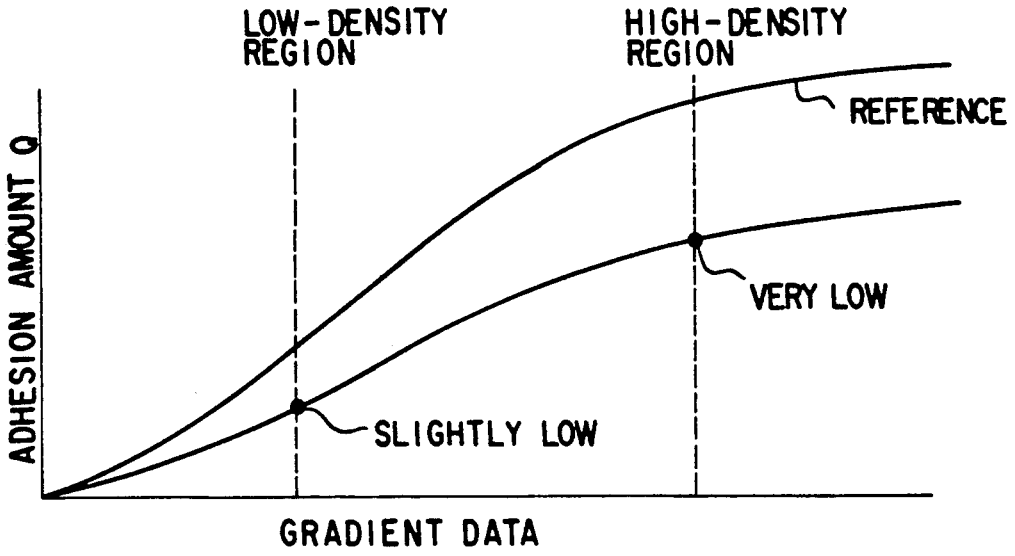
FIG. 15 shows an example of the variation in gradient characteristics.
Figure 16:
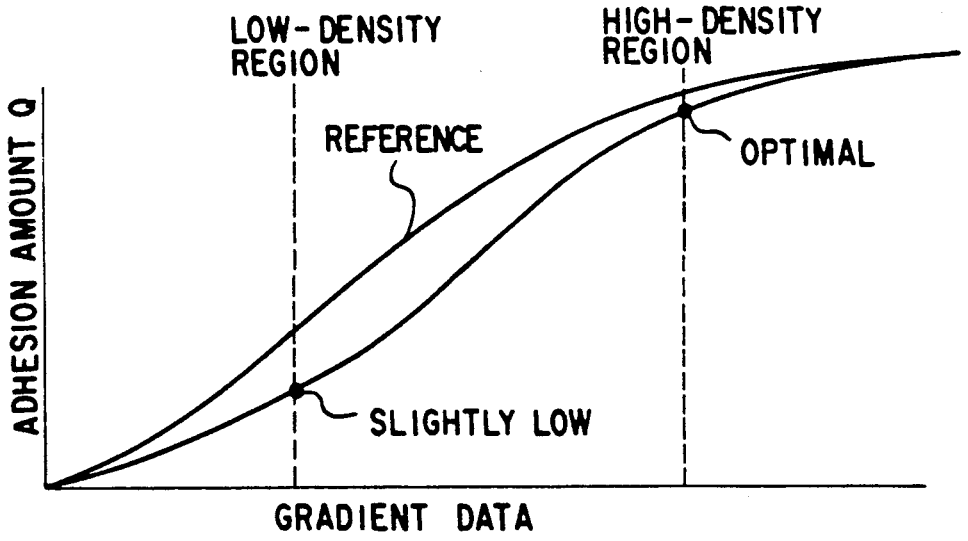
FIG. 16 shows another example of the variation in gradient characteristics.

FIGS. 15 and 16 show examples of variations in two different gradient characteristics. In FIGS. 15 and 16, it is assumed that the deviation of the low-density region is detected as the same value, and the deviation of the high-density region is very high in FIG. 15 but is substantially zero in FIG. 16. From the effect of the contrast voltage shown in FIG. 10 and the effect of the background voltage shown in FIG. 11, it can be guessed that it is effective to increase the contrast voltage principally when the deviation of the high-density region is very low (FIG. 15) and it is effective to slightly decrease the background voltage when the deviation of the high-density region is close to zero (FIG. 16).

The operation amounts are not independently determined from the deviation of the high-density region and low-density region, but the optimal operations amounts can be found in consideration of the relationship between the deviations of the high-density region and low-density region, as stated above.

In the first adhesion amount measuring step, when the deviation of the high-density region is slightly negative and the deviation of the high-density region is strongly negative, the renewal amount of the contrast voltage is increased to the positive side. The renewal amount of the background voltage is zero (i.e. is not changed).

Using the above results, the bias value is calculated and renewed, and thereafter the adhesion amount of the test patterns is measured once again. As a result of the bias change, it is assumed, from FIG. 10, that both the deviation of the high-density region and the deviation of the low-density region are varied to the positive side.

If both deviations fall within the range of the standard values, the control is completed. However, if the deviation of the high-density region falls within the range of standard values and the deviation of the low-density region is slightly out of the range of standard values towards the negative side, then the renewal amount of the contrast voltage is very slightly shifted to the negative side and the renewal amount of the background voltage is slightly shifted to the negative side.

When the background voltage is decreased, the image density increases towards the low-density region side. The image density on the high-density region must increase slightly, but it bares little since the contrast voltage is simultaneously slightly lowered.

By repeating the adhesion amount measurement and bias variation, as stated above, the sequential control of rough adjustment and fine adjustment can be executed. Specifically, based on the contents of the table of the memory unit 61 and the relationship between the deviations of the high-density region and low-density region, rough adjustment of mainly the high-density region can be effected by varying the contrast voltage and thereafter fine adjustment of both the high-density region and low-density region is effected simultaneously on the basis of the background voltage and contrast voltage.

Referring to FIGS. 17 to 20, the variations of the toner adhesion amount input to the measuring system in the control process and the variations of the bias values will now be described.

Figure 17:
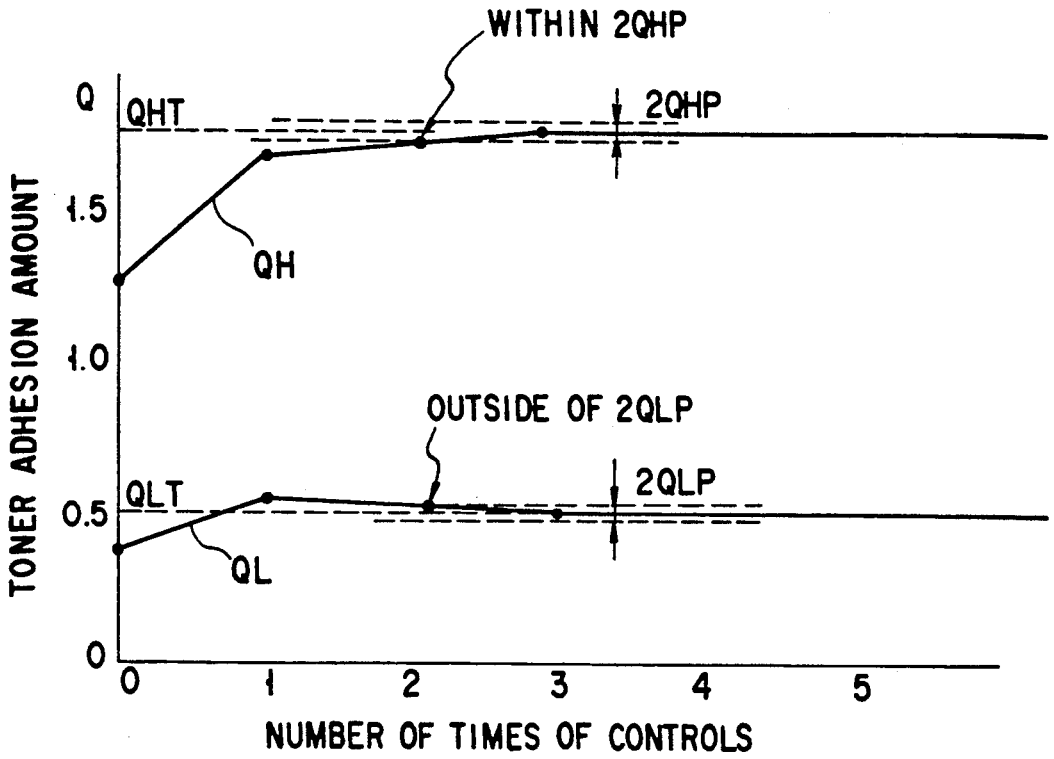
FIG. 17 illustrates the variation in toner adhesion amount which is input to the measuring system in the control process.
Figure 18:
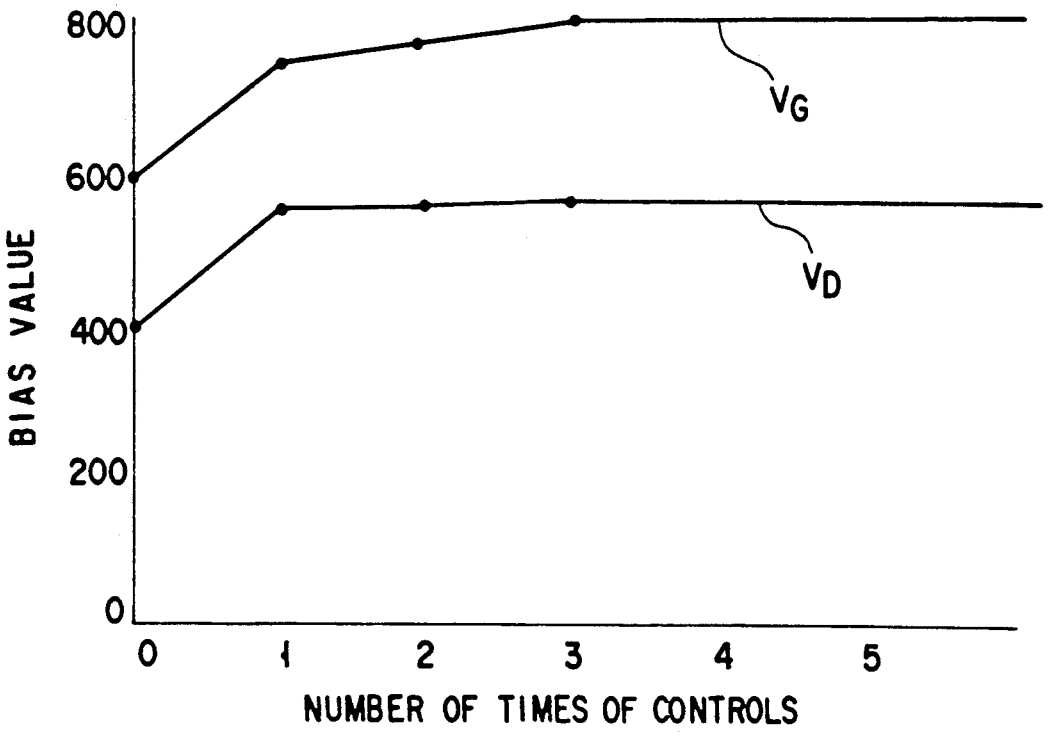
FIG. 18 illustrates the variation in bias value which is input to the measuring system in the control process.

FIGS. 17 and 18 show an example wherein the high-density toner adhesion amount QH and low-density toner adhesion amount QL at low temperature and low humidity are lower than target values QHT and QLT. The horizontal axis in FIGS. 17 and 18 indicates the number of times of controls, the vertical axis in FIG. 17 indicates the toner adhesion amount detection value, and the vertical axis in FIG. 18 indicates bias values.

In FIG. 18, when the number of times of controls is zero, the grid bias voltage value VG and development bias voltage value VD are set at predetermined initial values, and a high-density test pattern and a low-density test pattern are formed. Since the toner adhesion amount value QH of the high-density region and toner adhesion amount value QL of the low-density region, both detected with respect to the formed test patterns, are lower than target values QHT and QLT and fall out of the ranges QHP and QLP of control standard values, the renewal amounts are calculated in the bias renewing step.

If the deviation of the high-density region is very low (i.e. large to the negative side), the grid bias voltage value VG and development bias voltage value VD are renewed so as to increase the contrast voltage (the number of times of controls: 1).

The formation of the test pattern and the detection of the toner adhesion amount can be effected with the renewed bias voltage value. As can be seen from FIG. 10, by increasing the contrast voltage, both toner adhesion amount values QH and QL increase and approach the corresponding target values (the number of times of controls: 1).

When the number of times of controls is one, the toner adhesion amount value QH of the high-density region is lower than the target value QHT, and the toner adhesion amount value QL of the low-density region is higher than the target value QLT.

From the table of contents shown in FIGS. 13 and 14, the renewal amounts for slightly increasing the contrast voltage and for increasing the background voltage are extracted. According to these voltage renewal amounts, the grid bias voltage value VG and development bias voltage value VD are calculated and renewed (the number of times of controls: 2).

Once again, with the renewed bias voltage values, the test patterns are formed and the toner adhesion amounts are detected. In this case, since both toner adhesion amount values QH and QL do not reach the control standard values QHP and QLP (the number of times of controls: 2), the above-described bias renewing operation is repeated (the number of times of controls: 3). As a result, both toner adhesion amount values QH and QL fall within the ranges of control standard values QHP and QLP and the control process is completed. In this embodiment, the maximum number of times of controls is set to 5, but the values are converged by three controls and the control process is normally completed.

Figure 19:
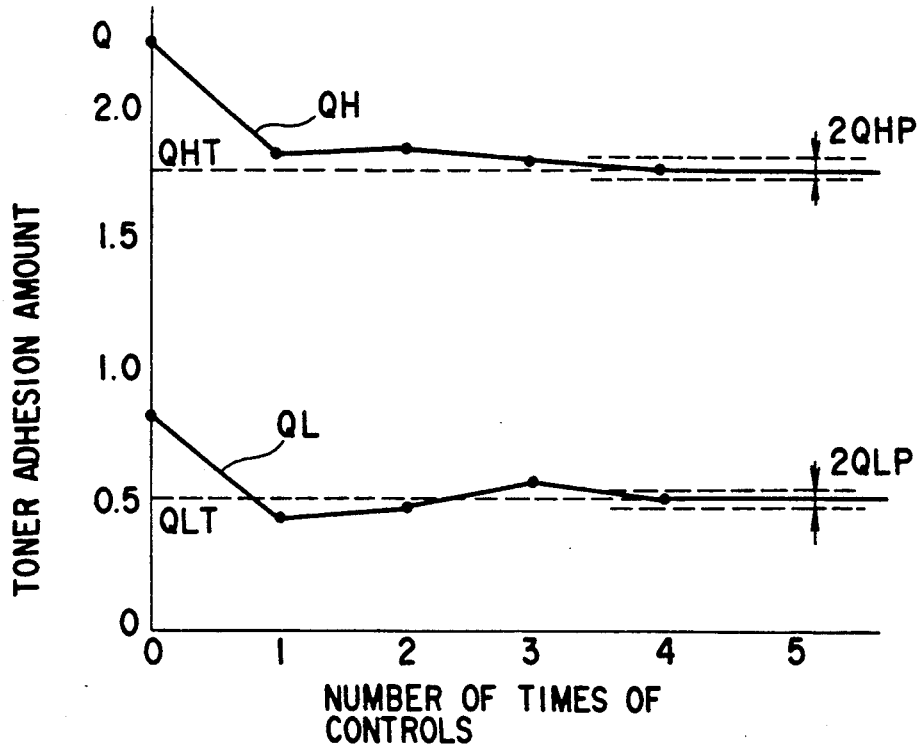
FIG. 19 illustrates the variation in toner adhesion amount which is input to the measuring system in the control process.
Figure 20:
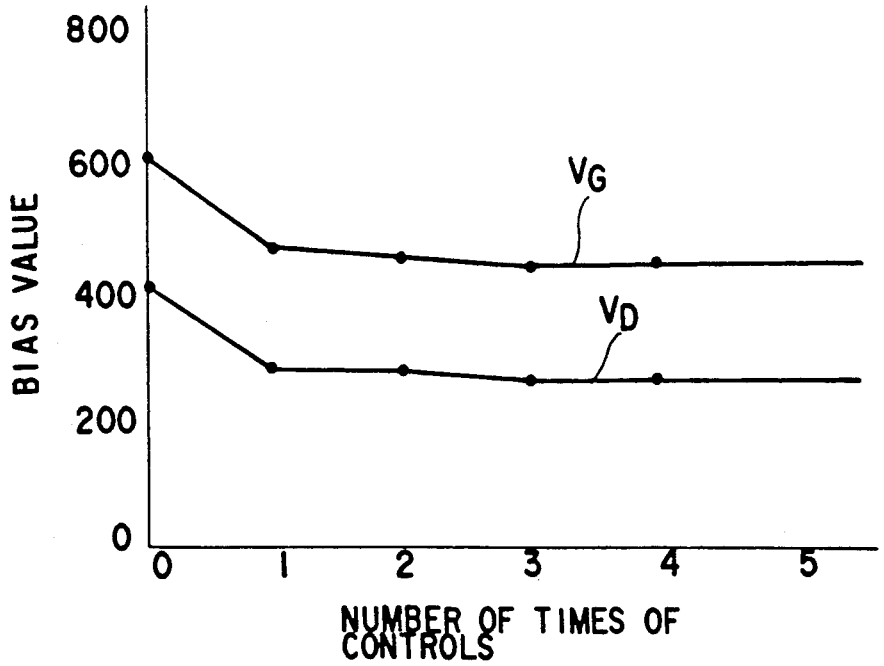
FIG. 20 illustrates the variation in bias value which is input the measuring system in the control process.

FIGS. 19 and 20 show an example wherein the high-density toner adhesion amount QH and low-density toner adhesion amount Q at high temperature and high humidity are higher than target values QHT and QLT. The horizontal axis in FIGS. 19 and 20 indicates the number of times of controls, the vertical axis in FIG. 19 indicates the toner adhesion amount detection value, and the vertical axis in FIG. 20 indicates bias values.

In this example, at the initial bias values, the high-density region toner adhesion amount QH and low-density region toner adhesion amount QL are higher than the target values QHT and QLT (the number of times of controls: 0). By decreasing the contrast voltage, the grid bias voltage value VG and development bias voltage value VD are varied (the number of times of controls: 1). The toner adhesion amount value QH and the toner adhesion amount value QL of the low-density region approach the target values QHT and QLT. Thereafter, principally, the background voltage is varied and the contrast voltage is finely varied, thereby converging the values of these voltages within the ranges of control standard values. In this example, the convergence of voltage values requires four control operations.

As stated above, from the relationship between the deviations of the high-density region and low-density region, the parameters of the renewal amounts effective for the high-density region and low-density region are derived (extracted) from the table simultaneously or independently. The renewal based on the renewal amounts is realized by changing the image forming conditions, and the effects of renewal are confirmed once again. If the deviations are out of the ranges of standard values, the control is repeated and converged to target values.

In the above example, the control operation is started when the power is supplied to the apparatus. In the present embodiment, the control operation can be started when the door (not shown) of the apparatus is opened/closed, when an external control execution command is delivered, when a predetermined time has passed from the completion of control, when the number of printing sheets exceeds a predetermined value after the completion of control, or the toner empty state is released.

The control completion conditions will now be described.

Specifically, when both the deviations of the high-density region and low-density region fall within the ranges of predetermined control standard values stored in the memory unit 61 (normal completion), the control completion condition is that a predetermined number of times of controls (bias variation) stored in the memory unit 61 have been performed (the execution of a maximum number of times of controls), that the calculation result of the bias variation value has reached a predetermined bias condition value stored in the memory unit 61 (limit of operation amount), or that the output from the toner adhesion amount measuring unit 8 has met the predetermined condition (abnormal range) stored in the memory unit 61 (i.e. the output of the sensor is abnormal).

For example, when both the deviations of the high-density region and low-density region are within the ranges of predetermined control standard values (normal completion), that is, when both the deviations of the high-density region and low-density region fall within the target ranges of predetermined control standard values in the determination step, the grid bias voltage value and development bias voltage value are retained and the apparatus is set in the wait state. In other words, the target values have been reached and the control operation has normally been completed.

A description will now be given of the processing of the inference unit 65 functioning as inference means for inferring the renewal amount of the contrast voltage and the renewal amount of the background voltage in the bias changing step.

Since the inference unit 65 is provided as inference means for performing inference within the apparatus, the memory capacity can be reduced and the renewal operation is simplified.

The following label groups and data groups are prepared in relation to the deviations of the high-density region and low-density region, which are input to the inference unit 65, and these groups are stored in the memory unit 61:

(1) a plurality of labels (first input label group) for qualitatively representing, as a membership function, the quantity corresponding to the deviation of the high-density region;

(2) a plurality of labels (second input label group) for qualitatively representing, as a membership function, the quantity corresponding to the deviation of the low-density region;

(3) a value (first input belonging degree data group) qualitatively representing the degree which expresses the meaning of each label of the first input label group relating to the value of the deviation of the high-density region, i.e. a value representing the degree of belonging to each label; and (4) a value (second input belonging degree data group) qualitatively representing the degree which expresses the meaning of each label of the second input label group relating to the value of the deviation of the low-density region, i.e. a value representing the degree of belonging to each label.

The following label groups and data groups are prepared in relation to the renewal amount of the contrast voltage and the renewal amount of the background voltage, which are outputs of the inference unit 65, and these groups are stored in the memory means:

(5) a plurality of labels (first output label group) qualitatively representing the quantity corresponding to the renewal amount of the contrast voltage;

(6) a plurality of labels (second output label group) qualitatively representing the quantity corresponding to the renewal amount of the background voltage;

(7) a value (first output belonging degree data group) qualitatively representing the degree which expresses the meaning of each label of the first output label group relating to the value of the renewal amount of the contrast voltage, i.e. a value representing the degree of belonging to each label;

(8) a value (second output belonging degree data group) qualitatively representing the degree which expresses the meaning of each label of the second output label group relating to the value of the renewal amount of the background voltage, i.e. a value representing the degree of belonging to each label; and (9) Using the above labels plurality of output labels of the inference unit 65 relating to the respective input labels of the inference unit 65 are prepared as rules and stored in the memory means.

FIGS. 21A and 21B, FIGS. 22A and 22B, FIGS. 23A and 23B show examples of the labels, the belonging degree data and the rules relating to the above items (1) to (9). These are stored in the memory unit 61.

(10) The inference unit 65 is provided to perform, by using the aforementioned labels, belonging degree data and rules, the processing sequence for inferring the renewal amount of the contrast voltage and the renewal amount of the background voltage on the basis of the values of deviations of the high-density region and low-density region obtained by the measured results of the toner adhesion amount measuring unit 8.

As shown in FIGS. 21A and 21B, the labels are used to qualitatively represent the amounts. For example, the labels indicate that the deviation of the high-density region is "not present", "slightly large in the positive direction", or "very large in the negative direction", by using signs such as "ZR", "PS" and "NB". These assigned categories or qualitative media are memorized in the apparatus.

Regarding the belonging degree data, for example, "ZR" corresponds to deviation "0" and belonging degree "1". As the deviation departs from "0" towards the positive side or negative side, the belonging degree decreases, e.g. "0.8", "0.5", "0.2" and "0". (In this embodiment, standardized integer values of 0–255 are used in the processing of the apparatus. Thus, the belonging degrees in this example are expressed by "255", "204", "128", "51" and "0".)

The value of the matching degree represents the degree of applicability of various words meaning "there is no deviation". For example, when the value of deviation of the high-density region is 1.0, the corresponding label means "there is no deviation exactly". When the value is 0.2, the label means "there is hardly any deviation". When the value is 0.8, the label means "there is a little deviation", and when the value is 0, the label means "it cannot be said that there is no deviation".

The rule represents the output label relating to the input label. In the examples of FIGS. 24A and 24B, FIGS. 25A and 25B and FIGS. 26A and 26B, the relationship between O1 (renewal amount of contrast voltage) and O2 (renewal amount of background voltage) is expressed in matrixes in relation to the label of I1 (deviation of high-density region) and the label of I2 (deviation of low-density region).

These matrixes represent the conditions of inputs I1 and I2 and the conditions of outputs. For example, if I1 is NS (slightly negative) and I2 is PS (slightly positive), then O1 is PS and also O2 is PS. This relationship can be expressed by the IF/THEN format as follows:

RULE(n): IF I1=label (I1) AND I2=label (I2),

THEN O1=label (O1) AND O2=label (O2)

where RULE(n) is an n-th rule, and label () is the label relating to a parameter in parentheses ().

The nl-th rule can be similarly expressed as follows:

RULE(nl): IF I1=PS AND I2=PS,

THEN O1=PS and

O2=PS.

Each of all rules is an OR condition. Blank boxes in the matrixes indicate that there is no label corresponding to the input conditions. For example, if I1 is NS and I2 is NS, then O1 is PS but there is no label corresponding to O2.

If the rule at this time is an i-th rule, it can be expressed by

RULE(i): IF I1=NS AND I2=NS,

THEN O1=PS

Figure 27:
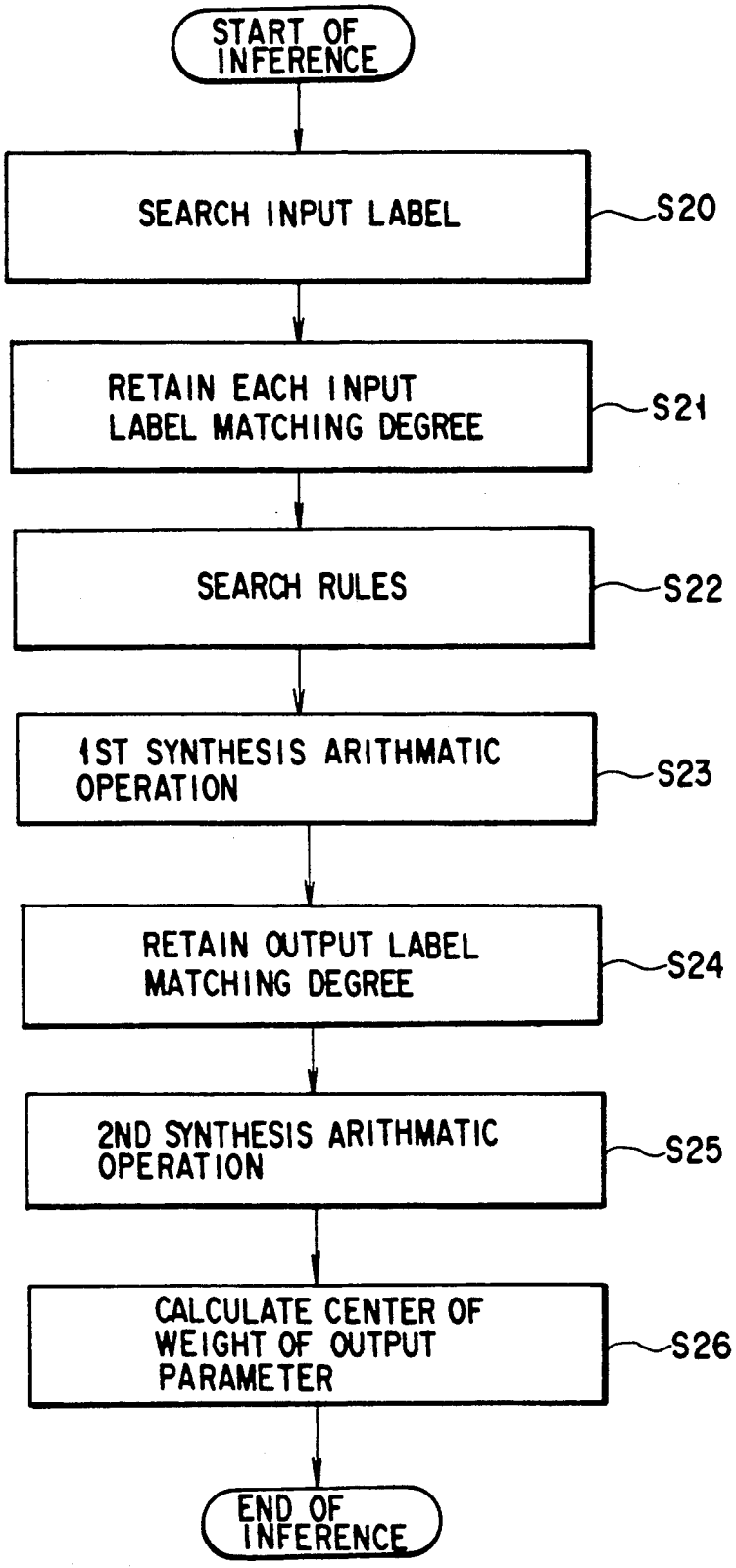
FIG. 27 is a flow chart illustrating the outline of the inference processing sequence.

Next, the outline of the inference processing will now be described with reference to the selection contents of the data shown in FIGS. 24A and 24B, FIGS. 25A and 25B, and FIGS. 26A and 26B, and the flow chart of FIG. 27.

When the bias changing step is initiated, the inference is conducted.

Input labels belonging to the input parameters, i.e. the values of the deviations of the high-density region and low-density region, are searched (step 20). ("NS" and "ZR" in FIG. 24A; "NS" and "ZR" in FIG. 24B.)

The belonging degrees of all searched input labels corresponding to the values of the input parameters are retained as matching degrees (step 21). ("g11" and "g12" in FIG. 24A; "g21" and "g22" in FIG. 24B.)

The rules corresponding to the searched input labels are searched (FIGS. 25A and 25B; step 22).

If there are the searched rules corresponding to the input labels, a predetermined first synthesis arithmetic operation is performed on the basis of the matching degree corresponding to the input condition for each searched rule associated with the input label (step S23). The operation result is retained as a matching degree of the label of the output condition of the rule (i.e. as a weight of the output label of each rule) (FIGS. 26A and 26B; step S24).

After the operation for each rule has been completed, a predetermined second synthesis arithmetic operation is performed for each output label having a matching degree (step S25). Thus, synthesis values for output parameter (or weights for output parameters) are calculated (FIGS. 26A and 26B; step S26).

Using the synthesis values found in connection with all output labels, the weight position of each output parameter is found. The weight position is output as an inference result (step S26).

Prior to the inference, the input gains of the input deviations (the deviations of the high-density region and low-density region) are adjusted and standardized (conversion to integers) by predetermined scaling factors.

Since the inference is performed in the integer system, the integer-based inference results (the renewal amount of contrast voltage and renewal amount of background voltage) are converted to actual voltage values by predetermined scaling factors.

The inputs I1 and I2 of the inference unit 65 are defined by the following equations:

$$I1 = SF1 \times \Delta QH$$

$$I2 = SF2 \times \Delta QL$$

where SF1 and SF2 are the scaling factors.

All labels having the belonging degrees of the inputs I1 and I2 of the inference unit 65 are searched.

If the corresponding labels are L(I1)1, L(I1)2, L(I2)1, and L(I2)2, the belonging degree of the input I1 relating to L(I1)1 is g(L(I1)1, I1), the following can be found definitely from data:

the belonging degree of the input I1 relating to L(I1)2 is g(L(I1)2, I1), the belonging degree of the input I2 relating to L(I2)1 is g(L(I2)1, I2), and the belonging degree of the input I2 relating to L(I2)2 is g(L(I2)2, I2).

Rules relating to the searched labels are searched.

Suppose that the corresponding rules are R1 to R4 having the following contents:

R1: If I1 is L(I1)1 and I2 is L(I2)1, then O1 is L(O1)1;

R2: If I1 is L(I1)1 and I2 is L(I2)2, then O1 is L(O1)1;

R3: If I1 is L(I1)2 and I2 is L(I2)1, then O2 is L(O2)1; and

R4: If I1 is L(I1)2 and I2 is L(I2)2, then O1 is L(O1)2 and O2 is L(O2)2.

Regarding these rules, the first arithmetic operation is performed to find the matching degrees of output and O2 relating to the inputs I1 and I2. Supposing that an algebraic product is obtained by the first arithmetic operation, the matching degrees of the rules can be found from the belonging degree g(L(I1)1, I1) of the input I1 relating to R1:L(I1)1 and the belonging degree g(L(I2)1, I2) of the input I2 relating to L(I2)1, in the following manner:

$$R1: \alpha(R1)=g(L(I1)1, I1)\times g(L(I2)1, I2);$$

$$R2: \alpha(R2)=g(L(I1)1, I1)\times g(L(I2)2, I2);$$

$$R3: \alpha(R3)=g(L(I1)2, I1)\times g(L(I2)1, I2); \text{ and}$$

$$R4: \alpha(R4)=g(L(I1)2, I1)\times g(L(I2)2, I2).$$

The second arithmetic operation is performed to calculate, from the above results, the matching degrees of the output labels corresponding to the respective rules. In this case, addition operations are performed.

| | |
|---|---|
| From R1 and R2, L(01)1: | $\alpha(L(01)1, 01) = \alpha(R1) + \alpha(R2)$; |
| From R4, L(01)2: | $\alpha(L(01)2, 01) = \alpha(R4)$; |
| From R3, L(02)1: | $\alpha(L(02)1, 02) = \alpha(R3)$; and |
| From R4, L(02)2: | $\alpha(L(02)2, 02) = \alpha(R4)$. |

When there is one rule corresponding to the associated output, as in the above example, the matching degree of the output label is equal to the matching degree of the associated rule.

From the matching degrees obtained by the second arithmetic operation for each label, the centers of weight of the respective output parameters are calculated and employed as values of outputs O1 and O2.

$$01 = (01(L(01)1) \times \alpha(L(01)1, 01) + 01(L(01)2) \times \alpha(L(01)2, 01))/(\alpha(L(01)1, 01) + \alpha(L01)2, 01)),$$

$$02 = (02(L(01)1) \times \alpha(L(02)1, 02) + 02(L(02)2) \times \alpha(L(02)2, 02))/(\alpha(L(02)1, 02) + \alpha(L02)2, 02)).$$

Since the output values O1 and O2, which are the aforementioned inference results, are standardized values, these values are converted to voltage values (the renewal amount of contrast voltage and the renewal amount of background voltage).

$$\Delta VC=SF3\times O1$$

$$\Delta VBG=SF4\times O2$$

where SF3 and SF4 are the scaling factors.

The constants used in the above formulas are defined as follows:

ΔQH: the measured high-density region deviation;

ΔQL: the measured low-density region deviation;

I1: the input value to the inference unit 65 corresponding to the deviation of the high-density region;

I2: the input value to the inference unit 65 corresponding to the deviation of the low-density region;

O1: the output value from the inference unit 65 corresponding to the renewal amount of contrast voltage;

O2: the output value from the inference unit 65 corresponding to the renewal amount of background voltage;

ΔVC: the inference result or the renewal amount of contrast voltage;

ΔVBG: the inference result or the renewal amount of background voltage;

L(I)m: the m-th label belonging to the input value I;

L(O)k: the k-th label relating to the output O;

g(L,I): the belonging degree to the input value I relating to the label L;

Rn: the n-th rule;

α(Rn): the matching degree of the output label relating to Rn; and

α(L,O): the matching degree to the output value O relating to the label L.

By virtue of the inference unit 65, the same input/output relationship as is achieved by using table data can be obtained with a less memory capacity. In the present embodiment, algebraic addition is used in the first arithmetic operation, and addition is used in the second arithmetic operation. However, the methods of arithmetic operations are not limited to these, and the same input/output relationship can be inferred by using the MIN arithmetic operation as the first arithmetic operation, or by using the MAX arithmetic operation as the second arithmetic operation. The method of arithmetic operations can be selected on the basis of the precision of operation processing, the speed of processing, and/or linearity.

The inference method of this embodiment, which employs the algebraic product, addition and weight-position processing, is linear, allows simple calculations, and reduces repetitive calculations. Thus, this method is suitable for high speed processing.

The aforementioned data capacity will now be described. For example, suppose that the data amount of each of ΔQH, ΔQL, ΔVC and ΔVBG is 256. In this case, the minimum capacity for storing the renewal amount of contrast voltage and the renewal amount of background voltage in the form of table data must be $256\times256\times2=131{,}072$ bytes.

On the other hand, suppose that the number of labels for each parameter is set to be 5 in the case of using the inference unit 65. In this case, the labels and the belonging degree data for labels require only $(256+1)5\times4=5{,}140$ bytes, even without data compression. In addition, the rules relating to the renewal amount of contrast voltage and the renewal amount of background voltage require only $5\times5\times2=50$ bytes at most.

In this example, the retention of the belonging degrees and rules relating to the labels of inference unit 65 requires only about 1/25 of the memory capacity in the case of retention by table data.

The inference unit 65 and memory unit 61 for storing data necessary for inference in the control circuit 45 will now be described.

Figure 28:
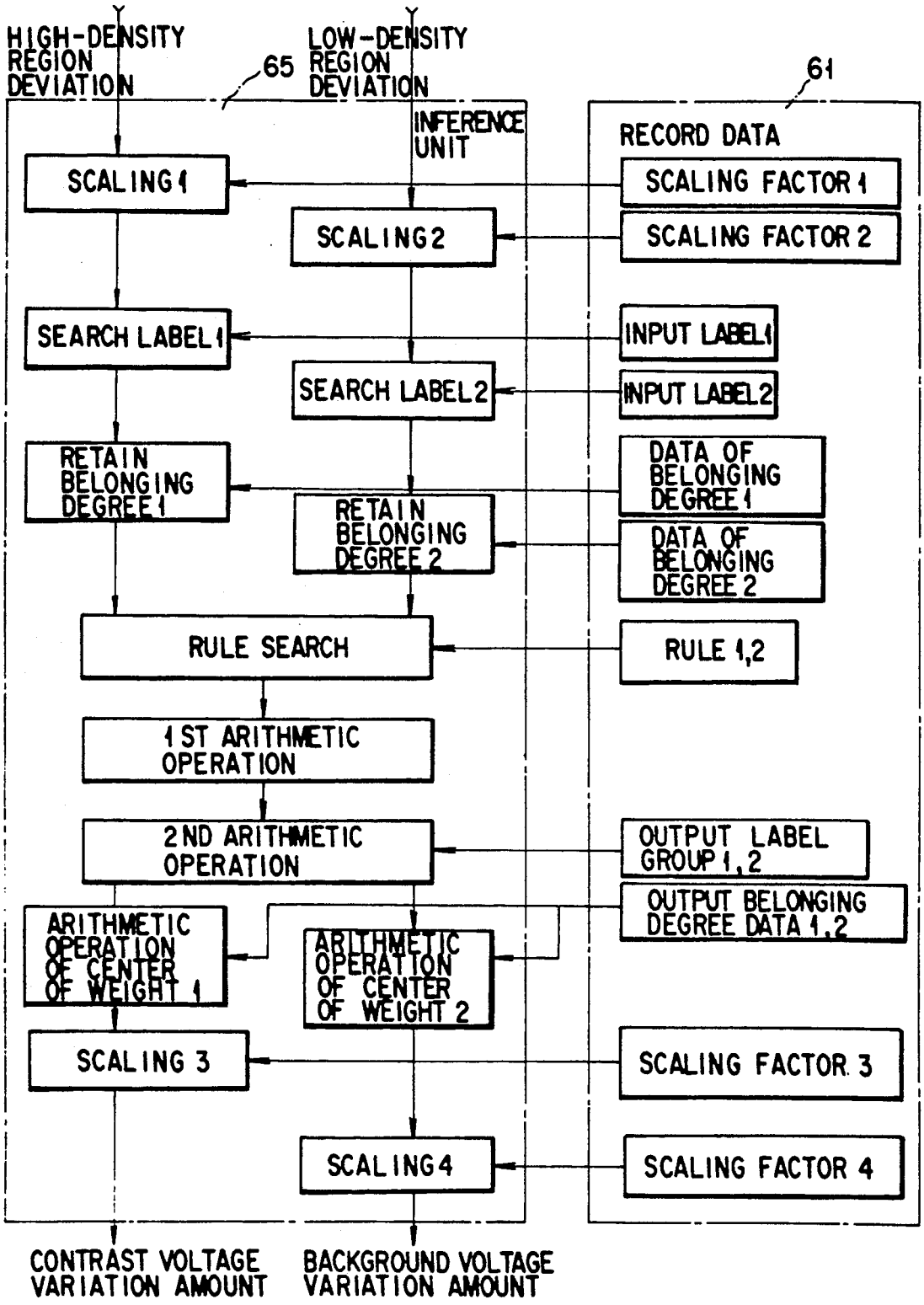
FIG. 28 is a block diagram illustrating the functions of the memory unit and inference unit shown in FIG. 2.

FIG. 28 is a block diagram illustrating the functions of the inference unit 65. The processing is performed in the order described with reference to the flow chart of FIG. 27. In the inference unit 65, the data stored in memory unit 61 as inference data is rewritten. Thereby the result of inference can be varied.

In the above example, the memory data is stored in the rewritable memory unit 61, the data in which is not erased even if the power is turned off. By using the operation key 49*a* and display panel 49*b* of the control panel 49 shown in FIG. 2, the contents of the memory unit 61 can be rewritten.

Specifically, the operation key 49*a* is operated and the CPU 64 recognizes a request for inference data rewrite mode. Thus, the CPU 64 initiates the inference data rewrite mode, and the menu is displayed on the display panel 49*b*.

The input/output scaling factors, labels, belonging data, and rules are selected by referring to the menu. The kind of the data to be rewritten is input by the operation key 49*a*. The CPU 64 reads out, from the memory unit 61, the current contents of the data of the input data kind, and enables the display panel 49*b* to display the graphs, tables, or data values shown in FIGS. 21A and 21B, FIGS. 22A and 22B and FIGS. 23A and 23B.

When the variation data value is input by the operation key 49*a*, the CPU 64 determines whether the variation data value is normal or not. If it is normal, the associated data in the memory unit 61 is rewritten, and the rewritten contents are displayed on the display panel 49*b*. If the variation data value is abnormal, the ΔCPU 64 enables the display panel 49*b* to display the request for re-input or input suspension due to the abnormality of the data.

As stated above, the data used in the inference unit 65 is stored in the rewritable memory unit 61, the data which is not erased even after the power is turned off. The inference processing is performed by using the data stored in the memory unit 61.

In addition, the inference results and bias set values relating to the inputs to the memory unit 61 in the control processes shown in FIGS. 17 to 20 are stored for a predetermined number of times of controls, and the input/output results (control past-history) can be displayed. Since the control past-history is stored and displayed, it becomes easy to decide how to rewrite the inference data.

It is also possible to store the inference data and inference programs in a read-only memory unit, and provide the apparatus with a connector for connecting/disconnecting the memory unit so that the memory unit can be replaced by another unit having different data.

It is also possible to provide the apparatus with a connector for connecting/disconnecting the memory unit in which only the memory data (inference data) shown in FIG. 28 is stored so that the memory unit can be replaced by another unit having different data.

As has been described above, the apparatus of this invention has toner adhesion amount measuring unit 8 for detecting the toner adhesion amount and a variation in the toner adhesion amount on the downstream side of the development process, in relation to the variations in image forming conditions and material characteristics due to ambient condition and passing of time associated with the electrostatic charging, exposure and development, among the sub processes of electrostatic charging, exposure and development of the electrophotography process. Based on the detection results of the toner adhesion amount measuring unit 8, the CPU 64 recognizes variation characteristics, determines of presence/absence of execution of control, and determines the operation amounts. The operation amounts are the bias voltage value of the grid electrode 33 of the electrostatic charger 2, which controls the charge amount in the charging process, and the development bias voltage value applied to the development roller 43 of the developing device 4 in the developing process.

Test patterns of two densities corresponding to predetermined two different gradient data are exposed under predetermined initial standard image forming conditions, and latent images thereof are formed. The latent images are developed by the developing device 4 into visible images. The toner adhesion amount measuring unit 8 provided on the downstream side of the development point detects the reflection light amount of the region on the photosensitive drum 1, to which toner is not adhered, and the reflection light amounts of the toner image regions of the two-density test patterns, in synchronism with the timing at which these regions come to the position of the measuring unit 8.

From the detection results, the amounts relating to the optical reflectances of the two test patterns with reference to the reflection light amount of the photosensitive drum 1 are defined as toner adhesion amounts. Of the two toner adhesion amounts, the amount corresponding to the high-density test pattern is termed the high-density region adhesion amount, and the amount corresponding to the low-density test pattern is termed the low-density region adhesion amount. The deviations of the high-density region adhesion amount and low-density region adhesion amounts from their target values are calculated, and the variations of the development characteristics (gradient characteristics) are found from both deviations.

When both deviations fall within the ranges of predetermined standard values, the operation relating to the bias voltage value is not performed, and the control operation is completed. If one of the deviations is greater than the standard value, the variation amount of the potential relationship representing the exposed-region potential, non-exposed-region potential and development bias voltage value are inferred from the recognized development characteristic variation, thereby decreasing the deviation.

The inference process includes inference of the variation amount of the relationship (hereinafter referred to as "contrast voltage") between the exposed-region potential and development bias voltage value on the basis of the relationship between the high-density region deviation and low-density region deviation, and inference of the variation amount of the relationship (hereinafter referred to as "background voltage") between the non-exposed-region potential and development bias voltage value on the basis of the relationship between the high-density region deviation and low-density region deviation.

Renewed grid bias voltage value and development bias voltage value are calculated from the inferred potential relationships and the preset functions including a coefficient representing the surface potential characteristics of the photosensitive drum 1.

Thus, by virtue of the inference unit, the control operation can be performed with a less memory capacity than in the case of retaining input/output data in the form of table data.

Since the data used in the inference unit can be replaced, the result of the inference unit, i.e. the control performance, can easily be varied.

Further, by displaying, rewriting and retaining the data used in the inference unit, the result of the inference unit and the control characteristics can be varied only by operating the control panel.

By storing and displaying the control past-history, it becomes easy to decide the process for variation. Since the process for variation can be performed on the basis of the rule change by using qualitative labels, expertise relating to control is not required and the control performance can be improved and optimized instinctively and empirically.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for stabilizing image density changes of an image formed on an image carrying body contained in an image forming apparatus, said image forming apparatus including memory means for storing, an input label group having input labels representing qualitatively the variations amounts of the gradient characteristics, an output label group having output labels representing qualitatively the renewal amounts of the factors relating to image formation conditions, an input belonging degree data group including data items representing quantitatively the degrees of matching with the meanings of the labels included in the input label group, an output belonging degree data group including data items representing quantitatively degrees of matching with meanings of the labels included in the output label group, and rule data for determining the relationship of correspondency between the labels of the input label group and the labels of the output label group, comprising the steps of:

A) detecting variation amounts of gradient characteristics of images formed on said image carrying body;

B) inferring renewal amounts of factors of the image formation condition on the basis of the variation amounts so as to decrease the variation amounts, the inference step including:

a first search step for searching, from the input label group, at least one of the input labels corresponding to the variation amounts of the gradient characteristics detected by the detection step;

a first processing step for finding the degree of matching with the qualitative data included in the input belonging degree data group with respect to each of at least one of the input labels searched by the first search step;

a second search step for searching the rule data corresponding to each of at least one of the input labels searched by the first search step, and searching, from the output label group, at least one of the output labels on the basis of the searched rule data;

a third search step for searching, from the output belonging degree data group, the data corresponding to at least one of the output labels searched by the second search step;

a second processing step for obtaining weight data corresponding to the renewal amounts associated with the output labels searched by the second search step, on the basis of the data searched by the third search step and the matching degree found by the first processing step; and a third processing step for calculating a weight position of the variation amount on the basis of the weight data corresponding to each of the output labels obtained by the second processing step, thereby inferring the renewal amounts of the factors relating to the image formation conditions; and C) changing the image forming condition on the basis of the inferred renewal amounts of factors of the image forming condition.

2. An image forming apparatus for forming an image on an image carrying body under a predetermined image forming condition, comprising:

means for detecting variation amounts of gradient characteristics of images formed on the image carrying body;

means for renewing said image formation condition on the basis of the variation amounts detected by the detection means, so as to decrease the variation amounts of gradient characteristics; and means for inferring renewal amounts of factors of said image formation condition so as to renew the image formation condition by said renewing means, the inference means including:

memory means for storing, an input label group having input labels representing qualitatively the variations amounts of the gradient characteristics, an output label group having output labels representing qualitatively the renewal amounts of the factors of said image formation conditions, an input belonging degree data group including data items representing quantitatively degrees of matching with meanings of the labels included in the input label group, an output belonging degree data group including data items representing quantitatively degrees of matching with meanings of the labels included in the output label group, and rule data for determining the relationship of correspondency between the labels of the input label group and the labels of the output label group;

first search means for searching, from the input label group, at least one of the input labels corresponding to the variation amounts of the gradient characteristics detected by the detecting means;

first processing means for finding the degree of matching with the qualitative data included in the input belonging degree data group with respect to each of at least one of the input labels searched by the first search means;

second search means for searching the rule data corresponding to each of at least one of the input labels searched by the first search means, and searching, from the output label group, at least one of the output labels on the basis of the searched rule data;

third search means for searching, from the output belonging degree data group, the data corresponding to at least one of the output labels searched by the second search means;

second processing means for obtaining weight data corresponding to the renewal amounts associated with the output labels searched by the second search means, on the basis of the data searched by the third search means and the matching degree found by the first processing means; and third processing means for calculating a weight position of the variation amount on the basis of the weight data corresponding to each of the output labels obtained by the second processing means, thereby inferring the renewal amounts of the factors of said image formation conditions.

3. The image forming apparatus according to claim 2, further including display means for displaying a contents of a replaceable rule data stored in the memory means, and operation means for performing an operation for changing the rule data.

4. The image forming apparatus according to claim 2, further including retention means for retaining input data and past-history data of inference result, and display means for displaying the past-history data.

5. The image forming apparatus according to claim 2, further including retention means for retaining past-history data, which is a renewal result of rule data, and display means for displaying the past-history data.

* * * * *